US005147271A

United States Patent [19]

Bacques et al.

[11] Patent Number: 5,147,271

[45] Date of Patent: Sep. 15, 1992

[54] MACHINE FOR PRODUCING POLYGONAL CASES

[75] Inventors: Jean-Yves Bacques, Paris; Guy Coalier, Noce, both of France

[73] Assignee: Otor, Paris, France

[21] Appl. No.: 727,117

[22] Filed: Jul. 9, 1991

[30] Foreign Application Priority Data

Jul. 24, 1990 [FR] France ..... 90 09457

[51] Int. Cl.[5] ..... B31B 3/28; B31B 3/02

[52] U.S. Cl. ..... 493/176; 493/143; 493/295

[58] Field of Search ..... 493/143, 153, 175, 176, 493/295

[56] References Cited

U.S. PATENT DOCUMENTS

| | | | |
|---|---|---|---|
| 2,967,655 | 1/1961 | Seger | 229/915 |
| 4,308,023 | 12/1981 | Bidegain | 493/295 |
| 4,349,345 | 9/1982 | Bodendoerfer | 493/295 |
| 4,843,798 | 7/1989 | Focke et al. | 493/911 |
| 4,932,930 | 6/1990 | Coalier et al. | 493/295 |

*Primary Examiner*—William E. Terrell

*Attorney, Agent, or Firm*—Fisher, Christen & Sabol

[57] ABSTRACT

A case, made from a sheet material such as cardboard or corrugated board, having rectangular lateral faces connected in twos by a fold line. The fold lines are parallel to each other. Such a case comprises at least five lateral faces. It may be obtained by wrapping a sheet material blank about a mandrel in cooperation with a pressure plate whose profile corresponds to that of two or three consecutive faces of the mandrel.

2 Claims, 19 Drawing Sheets

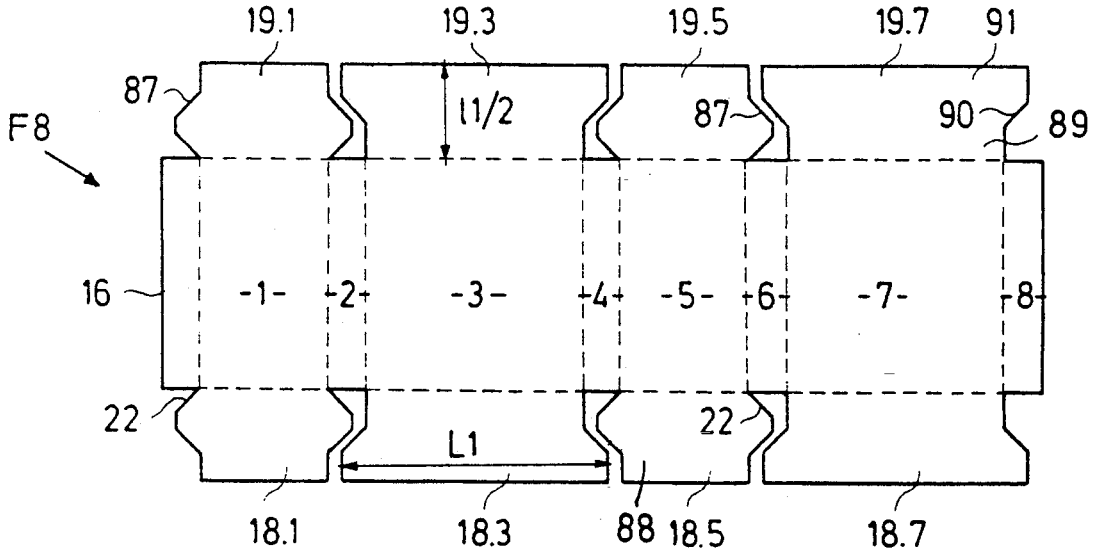
FIG. 35
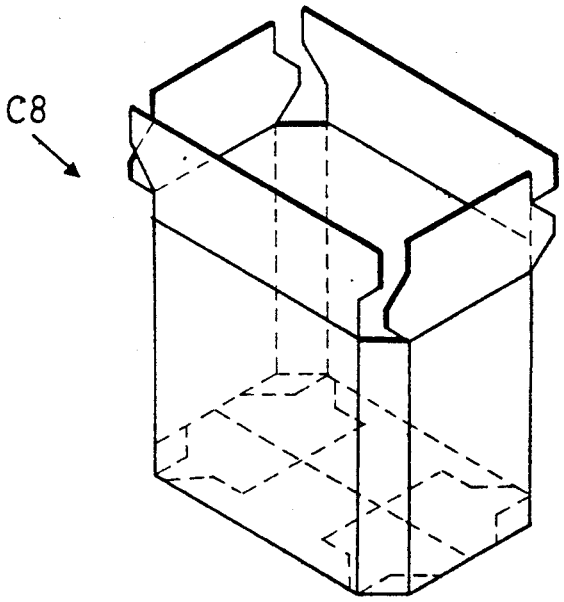
FIG. 36
FIG. 37
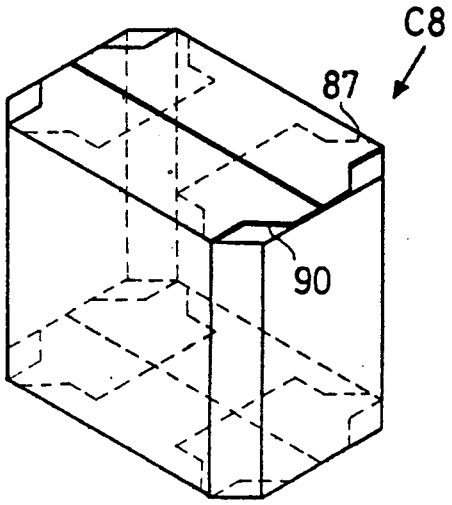

MACHINE FOR PRODUCING POLYGONAL CASES

BACKGROUND OF THE INVENTION

1. Field of the Invention

The invention relates to cases made from cardboard, corrugated board, or similar sheet material as well as the blanks of such material for forming said cases and a machine for producing said cases from said blanks.

2. Description of the Prior Art

From the patents U.S. Pat. No. 4,242,949, DE-A-3 541 821 and FR-A-2 629 012, for example, machines are known which are capable of producing a cardboard case or similar by wrapping a blank about a mandrel. In these machines, said mandrel has an essentially square or rectangular cross section, so that the cases obtained have four lateral faces defining a volume whose cross section, parallel to the bottom of said cases is also square or rectangular. Of course, two adjacent lateral faces are then orthogonal to each other and form an edge perpendicular to the bottom of the case.

Such cases are used for packing objects or groups of objects which are introduced therein through the lid which remains open, said lid only being closed after introduction of said objects.

It rarely, if ever, happens that the cross section of the load formed by said objects or groups of objects is square or rectangular and is exactly adapted to that of the case in which said load is introduced, so that said load is not firmly held in said case by the lateral faces thereof and the corners of the case are projecting and empty. The result is that the load may move inside the case, causing instability leading to difficulties in handling and loading on a transport means. In addition, the projecting corners of the case are exposed to external aggressions and may be easily torn, which adversely affects the presentation and protection of the packed products. Finally, the empty corners of the case form a waste of sheet material, since they are useless.

To partially overcome these drawbacks, the patent U.S. Pat. No. 4,308,029 proposes disposing an object to be packed inside said mandrel and wrapping the blank, under tension and with resilient deformation of two opposite lateral faces of the case. Thus, a square cross section package is obtained whose faces are exactly tangential to the walls of said object.

It will be noted that use of the machine described in this latter patent raises problems when a group of objects (and not a single object) are to be packed in the case. In addition, the package obtained also has projecting and empty corners, likely to be damaged and useless.

SUMMARY OF THE INVENTION

The object of the present invention is to overcome these drawbacks. For this, according to the invention, the case made from a sheet material, such as cardboard, or corrugated board, having square or rectangular lateral faces connected in twos by a fold line, said fold lines being parallel to each other, is remarkable in that it comprises at least five lateral faces.

Thus, because of the high number of said lateral faces of the case according to the invention:

the form of the cross section of the case can be best adapted to the cross section of the load which it is to contain, so that the load may be held laterally optimally;

the projecting empty and useless corners of the case may be suppressed, which reduces the risk of damage to the projecting corners and saves on sheet material. These projecting corners (dihedrals at 90°) are then transformed into more dihedrals (angel greater than 90°), which are less vulnerable to external aggression;

the number of lateral edges is increased and so the compression strength of the case, Preferably, said case has, parallel to its bottom, a quadrangular cross section with cut corners. It may comprises eight faces and have a rectangular cross section with four cut corners. It may also comprise only six lateral faces, the four corners being also cut. In a variant, the case according to the invention may comprise six lateral faces, with only two consecutive cut corners. In another variant, the case according to the invention comprises eight lateral faces and it has a square cross section with four cut corners. In this latter case, the eight lateral faces may be identical.

According to another embodiment, the case according to the invention has, parallel to its bottom, a triangular cross section with cut corners. It may comprise five lateral faces and have a triangular cross section with two cut corners. It may also comprise six lateral faces and have a triangular cross section with three cut corners.

Thus, according to the invention, a blank of sheet material, such as cardboard or corrugated board for forming the case according to the invention and comprising a succession of square or rectangular panels joined together by first fold lines parallel to each other and a first set of lateral flaps disposed on one side of said series of panels, connected thereto by second fold lines perpendicular to said first fold lines and intended to form at least partially the bottom of said case, is remarkable in that said succession comprises at least five panels.

Preferably, this blank comprises in addition a second set of lateral flaps disposed on the other side of said succession of panels, joined thereto by third fold lines perpendicular to said first fold lines and intended to form at least partially the lid of said case.

Some panels may not comprise lateral flaps of said first set and/or of said second set.

It is advantageous for at least one flap of said first set and/or of the second set to have, at least in the vicinity of said second or third corresponding fold line, the form of the cross section of the case obtained from said blank.

Two flaps, respectively from said first and second sets of flaps, connected to the same panel, may be identical or different in form.

Advantageously, a panel comprising neither a flap of said first set nor a flap of said second set comprises, on the other hand, a stub on its edge located on the same side as said first set of flaps and a notch on its edge located on the same side as said second set of flaps, so that when two cases obtained from two such identical blanks are superimposed, the stub of the lower case penetrates into the notch of the upper case. The cases thus obtained can then be readily stacked.

In a variant, for the same purpose, the flaps of said first and second sets, which are situated on the outside when the case is formed, have complementary shapes so that when two such cases are superimposed, the flaps of said first set of the lower case fit into the flaps of said second set of the upper case.

In order to further reinforce the strength of the case according to the invention, it is advantageous for at least one flap of said first set and/or said second set to have at least one foldable lug able to be fixed to a panel, when the case is formed from said blank.

In the French patent FR-A-2 629 012, a machine is described for forming a case from a sheet material blank having a succession of square or rectangular panels connected together by first fold lines parallel to each other and a first set of lateral flaps disposed on one side of said succession of panels, joined thereto by second fold lines perpendicular to said first fold lines and intended to form at least partially the bottom of said case, said machine comprising:

a mandrel, whose external cross section corresponds to the internal cross section of said case to be obtained;

means for freely supporting an intermediate panel of said succession of panels at least approximately opposite the corresponding face of said mandrel, but at some distance therefrom, then bringing said intermediate panel towards said corresponding face of the mandrel, then pressing said intermediate panel against said corresponding face, after folding of the panels adjacent said intermediate panel until said adjacent panels bear against said mandrel;

means for wrapping said succession of panels about said mandrel;

means for fixing together the end panels of said succession of panels thus wrapped about said mandrel;

means for folding the flaps of said first set against a corresponding face of said mandrel; and means for fixing said flaps thus folded together.

Such a machine overcomes the drawbacks inherent in those provided for producing American cases. It is therefore advantageous to improve such a machine for manufacturing cases according to the invention.

To this end, according to another aspect of the present invention, the machine of the above recalled type is remarkable in that said mandrel comprises at least five faces and in that said support, drawing together and pressure means for said intermediate panel comprise a pressure plate with two faces connected rigidly together, the first of said faces corresponding to said intermediate panel and the second to a first panel adjacent said intermediate panel, said first and second faces of the pressure plate defining a first dihedral such that, when said first face is applied against said corresponding face of the mandrel, said second face which is applied against the face of said mandrel corresponds to said first adjacent panel, the edge of said first dihedral then being in coincidence with the edge of said mandrel defined by said corresponding faces of said mandrel.

Thus, two panels of said blank are perfectly positioned with respect to the mandrel and are held in position with respect to the corresponding faces thereof during wrapping of said blank, so that the case obtained has a particularly precise shape.

To further increase this precision, it is advantageous for said pressure plate to have a third face rigidly connected to said first and second faces of said plate and corresponding to the second panel adjacent said intermediate panel, said first and third faces of the pressure plate defining a second dihedral such that, when said first and second faces are applied against said faces of the mandrel which correspond thereto, said third face is applied against the face of said mandrel corresponding to said second adjacent panel, the edge of said second dihedral being then in coincidence with the edge of said mandrel defined by said corresponding faces of said mandrel. Thus, during the final phase of wrapping the panels, three of them are disposed precisely and held firmly in position against the corresponding faces of the mandrel.

Advantageously, said means for wrapping said succession of panels about the mandrel comprise a mobile assembly with swinging arms.

BRIEF DESCRIPTION OF THE DRAWINGS

The figures of the accompanying drawings will better shown how the invention may be put into practice. In these figures, identical references designate similar elements.

FIGS. 17, 20, 23, 26, 29, 32, 35, 38, 41, 44, 47, 50, 53 and 56 show, flat, respectively blank variants according to the invention;

FIGS. 18, 21, 24, 27, 30, 33, 36, 39, 45, 48, 51, 54 and 57 show, in perspective, the cases obtained respectively from the blanks of FIGS. 17, 20, 23, 26, 29, 32, 35, 38, 44, 47, 50, 53 and 56, said cases having their lids open.

FIGS. 19, 22, 25, 28, 31, 34, 37, 40, 42, 46, 49, 52, 55 and 58 show, in perspective, the cases obtained respectively from the blanks of FIGS. 17, 20, 23, 26, 29, 32, 35, 38, 41, 44, 47, 50, 53 and 56, said cases having their lids closed.

DESCRIPTION OF THE PREFERRED EMBODIMENTS

Figure 1:
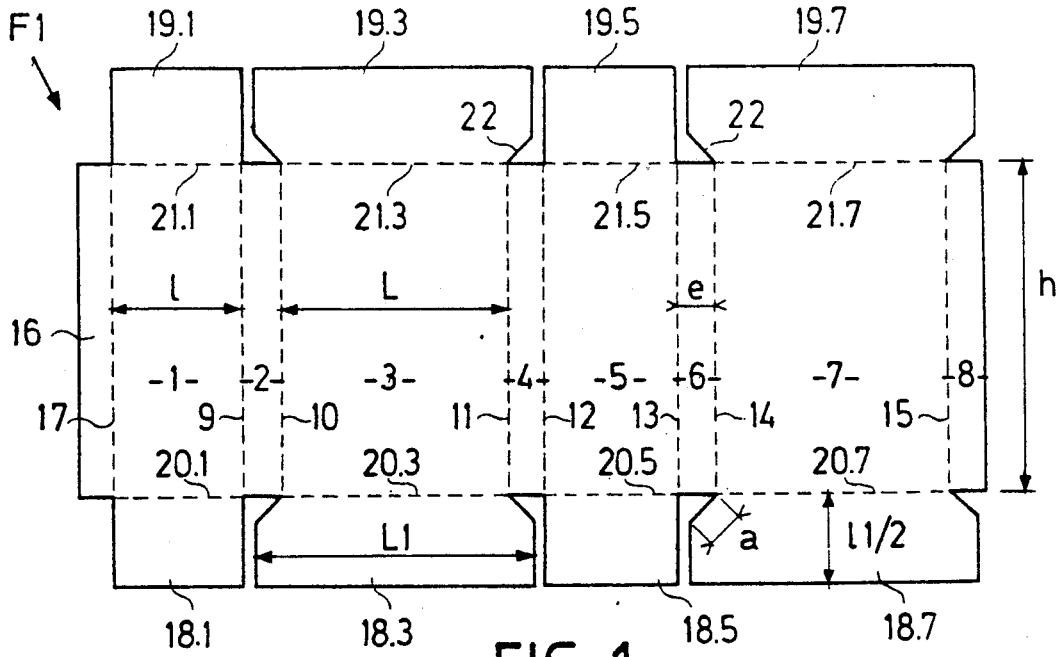
FIG. 1 shows a flat blank of sheet material for producing a first embodiment of a case according to the invention.

The blank F1 of sheet material, for example cardboard or corrugated board, shown in FIG. 1, comprises a succession of eight aligned rectangular panels 1 to 8, joined together in twos by preformed parallel fold lines 9 to 15. Along the free edge of the end panel 1 of said succession of panels is disposed a tongue 16 which is connected to said end panel 1 by a fold line 17, parallel to the fold lines 9 to 15.

Furthermore, on each side of each panel 1, 3, 5 and 7 flaps 118.1, 18.3, 18.5, 18.7 and 19.1, 19.3, 19.5 and 19.7 are respectively provided. Each lateral flap 18.1, 18.3, 18.5, 18.7 is hinged to the corresponding panel 1, 3, 5 or 7 by a preformed fold line 20.1, 20.3, 20.5 or 20.7. These fold lines 20.1, 20.3, 20.5 and 20.7 are aligned and perpendicular to the fold lines 9 to 15 and 17. Similarly, each lateral flap 19.1, 19.3, 19.5 and 19.7 is hinged to the corresponding panel 1, 3, 5, 7 by a preformed fold line 21.1, 21.3, 21.5, or 21.7. The fold lines 21.1, 21.3, 21.5 and 21.7 are aligned and perpendicular to the fold lines 9 to 15 and 17. The panels 2, 4, 6 and 8 have no lateral flap.

The rectangular panels 1 to 8 all have the same height h. The two panels 1 and 5 are identical to each other and have a width 1. The two panels 3 and 7 are identical to each other and have a width L, greater than 1.

The four panels 2, 4, 6 and 8 are identical to each other and have a width e less than 1. The height h is greater than L.

Figure 3:
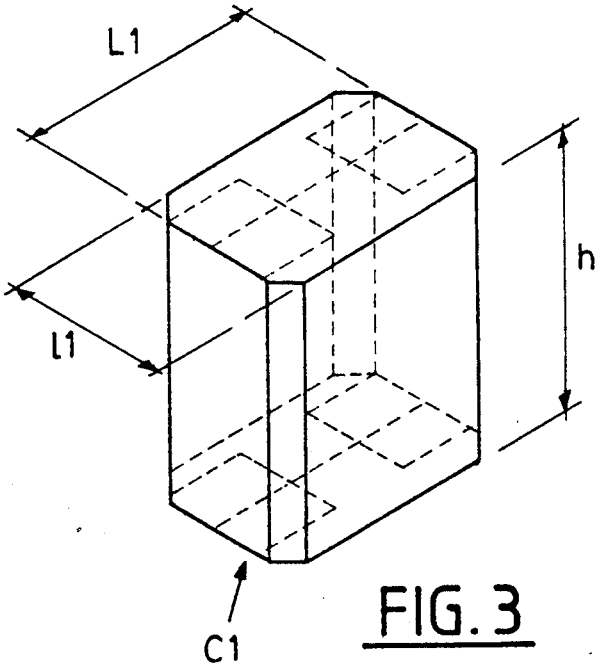

The blank F1 is intended to form, by wrapping and fastening panels 1 to 8 and fastening flaps 18.1, 18.3, 18.5, 18.7, 19.1, 19.3, 19.5 and 19.7 — in the way described hereafter in greater detail with reference to FIGS. 5 to 16 — the case C1 shown in FIG. 3. The case C1 has a height equal to h, a length L1 and a width 11. It has the general appearance of a case with rectangular cross section and four cut corners. In case C1, the large lateral faces are formed by panels 3 and 7, whereas the small lateral faces are formed by panels 1 and 5, panels 2, 4, 6 and 8 forming the cut corners of said case C1. In addition, the bottom of case C1 is formed by flaps 18.1, 18.3, 18.5, 18.7, whereas the lid of said case C1 is formed by flaps 19.1, 19.3, 19.5 and 19.7.

The four flaps 18.1, 18.5, 19.1 and 19.5 are identical and rectangular. They have a length equal to the width 1 of panels 1 and 5.

Flaps 18.3, 18.7, 19.3 and 19.7 are identical to each other. They have a length equal to the length L1 of case C1 and a width $1\frac{1}{2}$ equal to half the width 11 thereof. The flaps 18.3, 18.7, 19.3 and 19.7 whose length L1 is greater than the width L of the corresponding panels 3 and 7, are joined to said panels by a convergent portion whose inclined edges 22 have a length a equal to the width e of panels 2, 4, 6 and 8. Thus, each of said flaps 18.3, 18.7, 19.3 and 19.7 corresponds in form to half the cross section of case C1.

Figure 4:
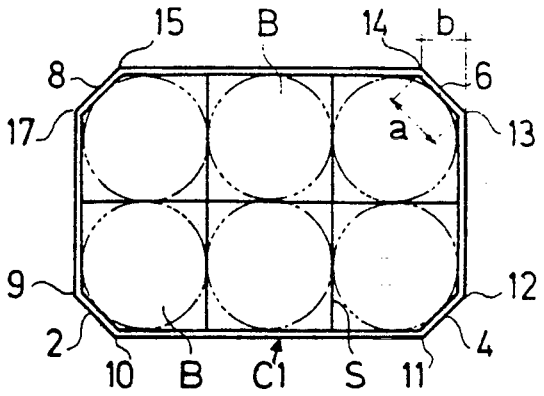
FIG. 4 illustrates, in cross section parallel to its bottom, use of the case of FIGS. 2 and 3.

In FIG. 4, an application of case C1 has been shown, in cross section, to the packing of six bottles B separated by separating cross-pieces S. It can be seen that, because of the cut corners corresponding to panels 2, 4, 6 and 8, the end bottles B are held well in position since these cut corners are tangential thereto. These corners, which project very little, are relatively invulnerable to external aggressions. In addition, at each corner, with respect to a known rectangular case, it can be seen that only a proportion a/2b of sheet material is used. If the faces 2, 4, 6 and 8 are inclined at 45° with respect to faces 1, 3, 5 and 7, this proportion is equal $1/\sqrt{2}$, i.e. equal to 70%. The result is, for each corner, a saving in material of 30%.

Finally, the case C1 has eight lateral edges, corresponding respectively to the fold lines 9 to 17, which confers thereon a compression strength greater than that of a rectangular cross section case.

Figure 2:
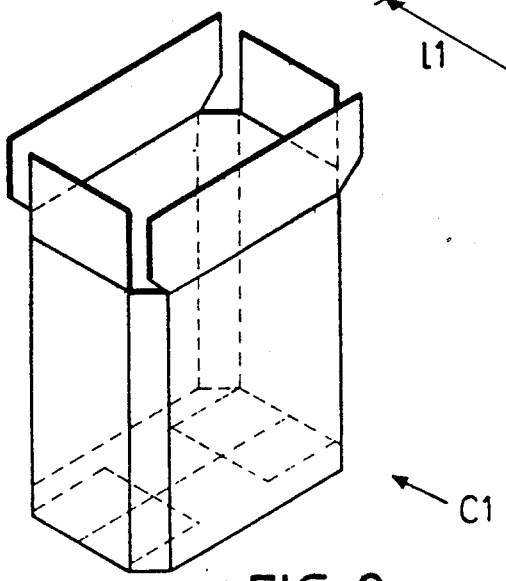
FIGS. 2 and 3 show in perspective the case obtained from the blank of FIG. 1, the lid of said case being shown respectively open (FIG. 2) and closed (FIG. 3)

In FIGS. 8 to 16, a machine has been illustrated schematically for manufacturing the case C1, with open lid, such as shown in FIG. 2. For the sake of clarity, these Figures are partial and simplified and they each comprise only the elements required for understanding the manufacturing phases which they illustrate.

Figure 5:
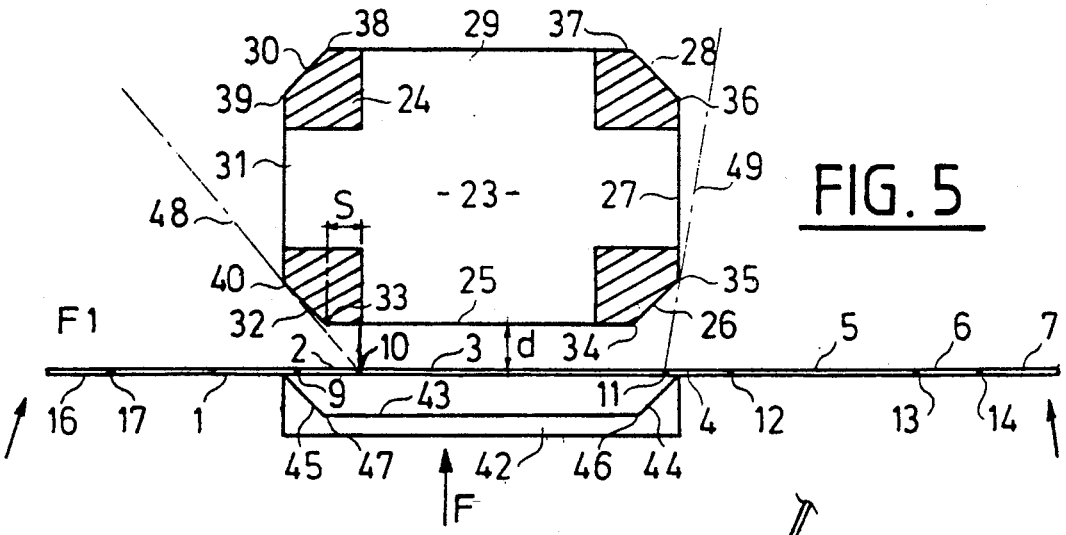
FIGS. 5, 6 and 7 illustrate schematically the procedure for forming the case of FIG. 2 from the blank of FIG. 1.
Figure 6:
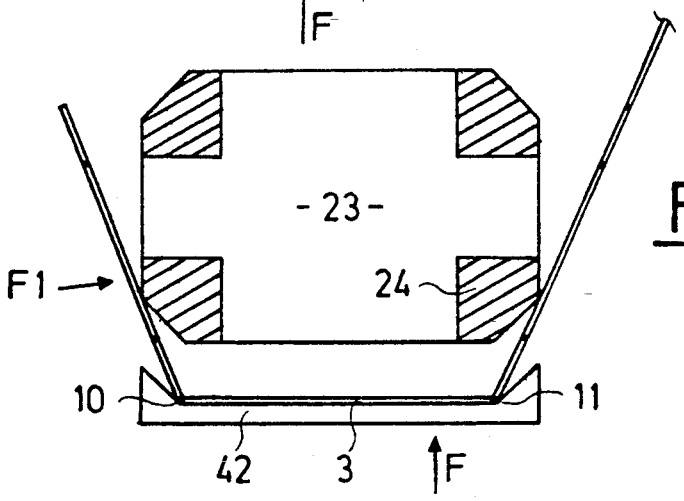
Figure 7:
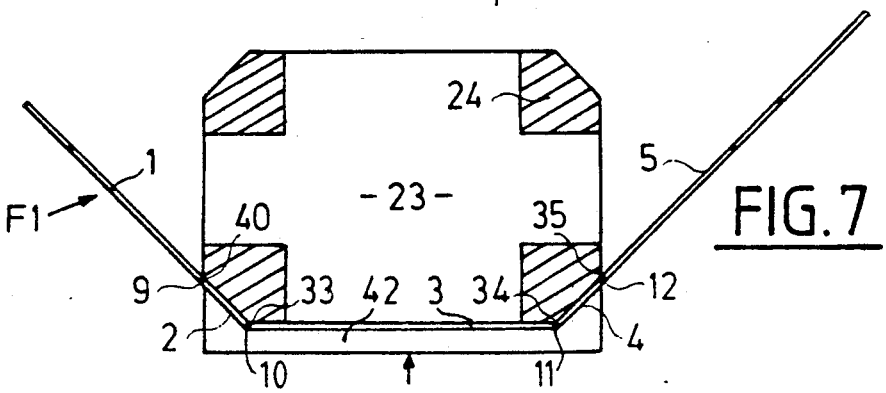

The machine of FIGS. 8 to 16 comprises a mandrel 23, shown on a larger scale in FIGS. 5 to 7, whose external shape corresponds to the internal shape of case C1 from blank F1. For this, the cross section of mandrel 23 is rectangular with cut corners. As shown in FIGS. 8 to 16, the length of mandrel 23 may be different from the height h of case C1. Mandrel 23 may be solid or only formed of a frame defining its edges, as is shown in said FIGS. 5 to 7. In these Figures, it has been assumed that said mandrel 23 was formed of parallel shaped sections 24 (seen in an end view in FIGS. 5 to 7) having a rectangular cross section with cut corners, defining lateral bearing faces 25 to 32 for the panels of blank F1, fold edges 33 to 40 corresponding to the fold lines between said panels and a front bearing face 41 for the flaps 18.1, 18.3, 18.5, 18.7, the contour of said bearing face 41 forming fold edges corresponding to the fold lines of said flaps 18.1, 18.3, 18.5, 18.7.

In FIGS. 5 to 7, the procedure has been shown schematically for positioning blank F1 with respect to mandrel 23, when it is desired to apply the intermediate panel 3 against the corresponding lower face 25 of mandrel 23.

Using known means, for example those shown in the document FR-A-2 629 012, a blank F1 is brought in the vicinity of mandrel 23, so that its panel 3 is disposed at least approximately facing the bearing face 25. Although the lateral positioning of said panel 3 with respect to said face 25 should be as precise as possible, it may happen that a slight shift $\delta$ occurs between panel 3 and said bearing face 25. To prevent premature folding of blank F1, outside the fold lines 10 and 11, at the time of folding the other panels of blank F1, before folding said other panels, panel 3 is moved away from the bearing face 25 by a distance d (see FIG. 5). Then, during folding of said panels 2, 1 and tongue 16 on the one hand, and panels 4 to 8 on the other hand, panel 3 is brought close to the bearing face 25 by means of a pressure plate 42 whose profile is concave and which, transversely to mandrel 23, has a face 43 which can be superimposed on the face 25 of said mandrel, a face 44 which can be superimposed on face 26 of the mandrel 23 and a face 45 which can be superimposed on the face 32 thereof, the faces 43 and 44 being connected together by an edge 46 which can be superimposed on edge 34, whereas faces 43 and 45 are connected together by an edge 47 which can be superimposed on edge 33. Thus, while panel 3 is brought closer to face 25 (arrow F), the panels 2, 1 and tongue 16, on the one hand, and panels 4 to 8, on the other hand, bear against mandrel 23 (see the dotted lines 48 and 49 in FIG. 5), which generates a lateral guiding effect and exactly positions panel 3 with respect to the bearing face 25 (see FIG. 6). When plate 42 presses panel 3 against the bearing face 25 (see FIG. 7), the fold lines 10 and 11 are superimposed exactly on the fold edges 33 and 34 and the fold lines 9 and 12 are superimposed exactly on the fold edges 40 and 35.

Figure 8:
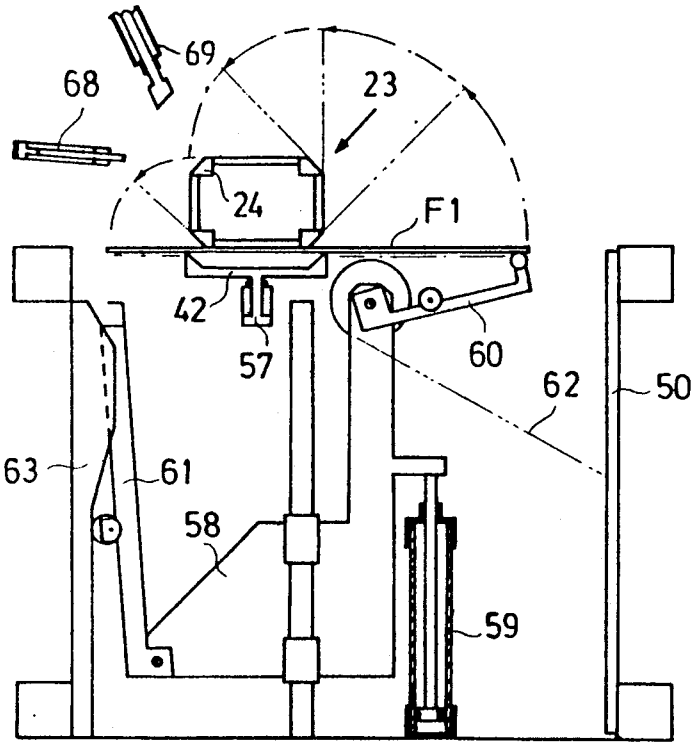
FIGS. 8, 10 and 12 are schematic elevational views of a machine for manufacturing the case of FIG. 2 from the blank of FIG. 1, at different stages of this manufacture.
Figure 14:
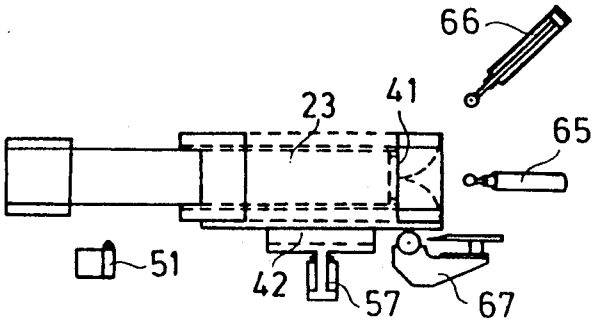
FIGS. 14, 15 and 16 illustrate schematically in partial lateral views, perpendicular to FIGS. 8, 10 and 12, the closure of the bottom of the case of FIGS. 2 and 3.
Figure 11:
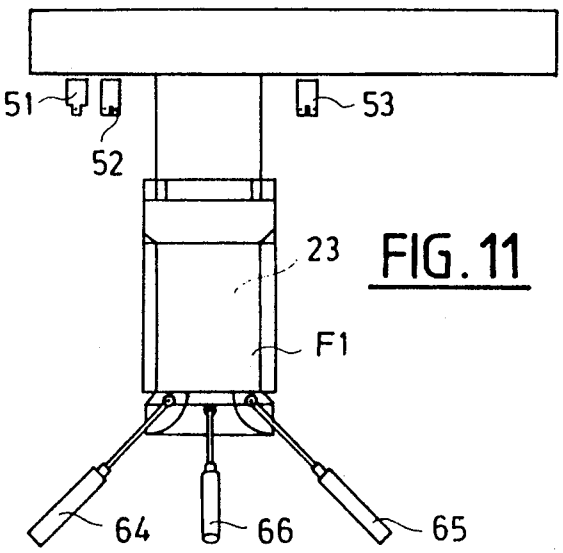
Figure 10:
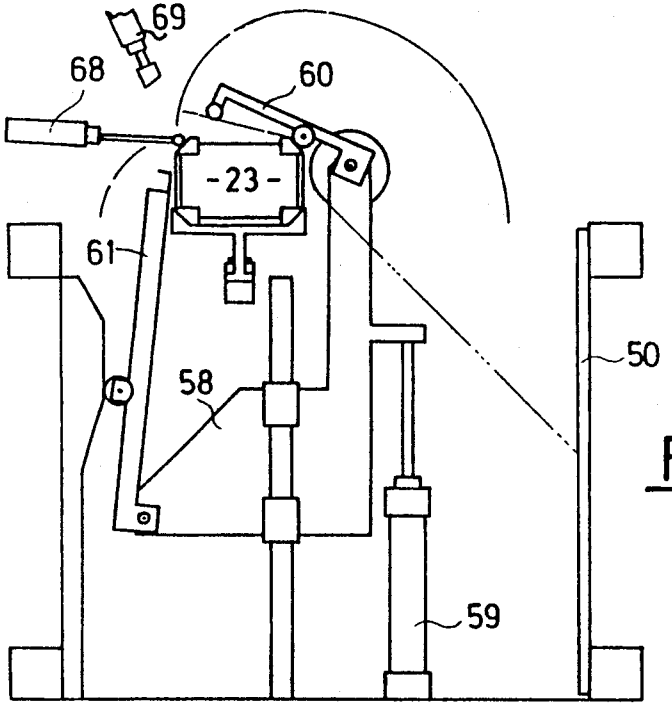
Figure 15:
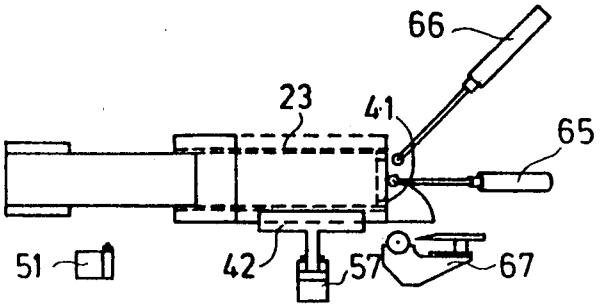
Figure 13:
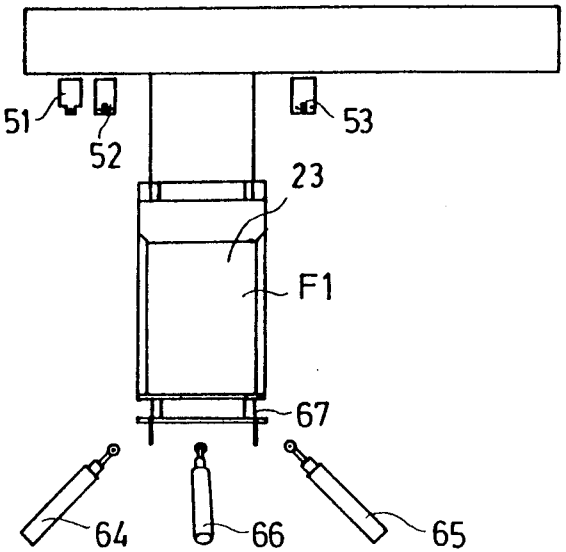
Figure 12:
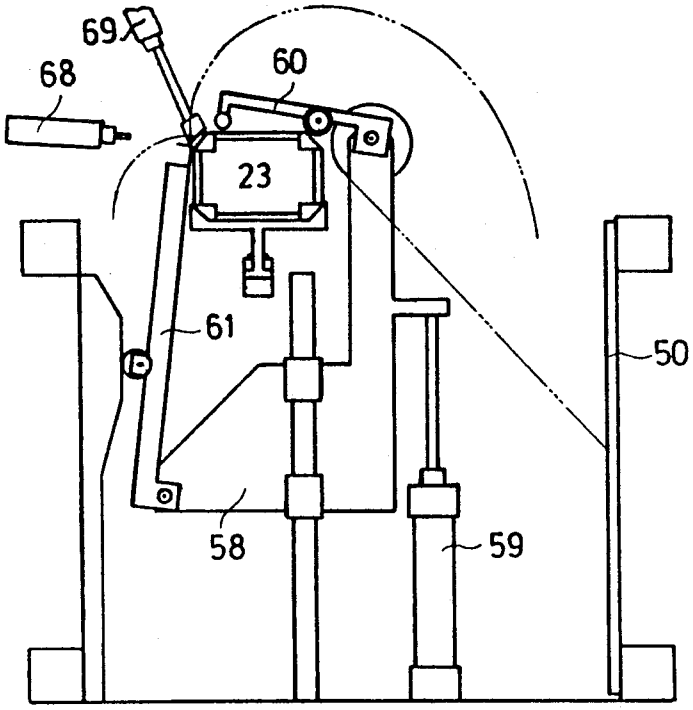
Figure 16:
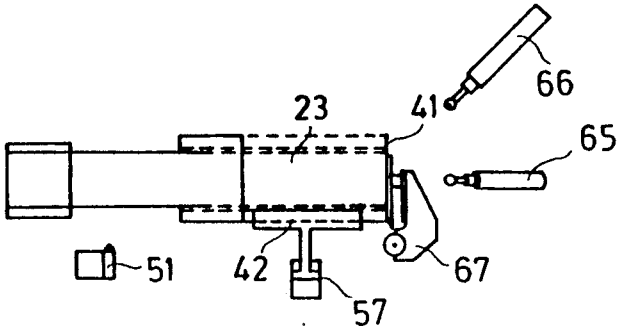

Since blank F1 is then temporarily fast with mandrel 23 because of the pressure exerted by plate 42, the formation of case C1 may be continued by wrapping blank F1 about said mandrel 23 (see the dotted lines in FIG. 8).

With such wrapping, the panels 1, 5, 6, 7 and 8 are respectively applied against the faces 31, 27, 28, 29 and 30 and tongue 16 is folded back on face 30 (before or after panel 8). It is then possible to fix tongue 16 and panel 8 together, for example by gluing.

Then, flaps 18.1 and 18.5 are folded about the edges of the front face 41 of the mandrel 23 corresponding respectively to the fold lines 20.1 and 20.5, so as to be applied against said corresponding front face 41 of mandrel 23.

Finally, flaps 18.3 and 18.7 are folded about the edges of the front face 41 of mandrel 23 corresponding respectively to the fold lines 20.3 and 20.7 and applied against flaps 18.1 and 18.5 which are already folded, so that said flaps 18.1, 18.3, 18.5, 18.7 may be fixed together, for example by gluing.

Then the case C1 shown in FIG. 2 is obtained, fitted on the mandrel 23 and open on the same side as flaps 19.1, 19.3, 19.5 and 19.7.

To fill this case C1, the mandrel 23 is removed and the case is set on its bottom formed of flaps 18.1, 18.3, 18.5, 18.7 which are secured together. After filling, case C1 may be closed by folding flaps 19.1 and 19.5 respectively about fold lines 21.1 and 21.5, then by folding flaps 19.3 and 19.7 on the folded flaps 19.1 and 19.5 and finally by fixing said flaps 19.1, 19.3, 19.5 and 19.7, for example by gluing. Then the closed case C1 shown in FIG. 3 is obtained.

The above operations may be carried out automatically using the machine illustrated schematically and partially in FIGS. 8 to 16. This machine has a frame 50 with respect to which the mandrel 23 and the pressure plate 42 are mounted. It further comprises a device (not shown) of any known type, for taking the blanks F1 one by one from a magazine and bringing them under mandrel 23. Glue spreaders 51, 52 and 53, mounted on frame 50, deposit lines of adhesive 54, 55, 56 respectively on tongue 16 and on flaps 18.1 and 18.5, while the blank F1 is being brought under mandrel 23.

Thus, with the glue spreaders 51 to 53, blank F1 is disposed, already glued, under mandrel 23 in the position shown in FIG. 5, above the pressure plate 42, which is driven by an actuator 57, carried by frame 50.

To wrap panels 1 to 8 and tongue 16 about mandrel 23, the machine comprises a mechanism with a mobile assembly 58 which may be raised or lowered by means of an actuator 59, bearing on frame 50.

The mobile assembly 58 has two articulated arms 60 and 61, for example driven respectively by a linkage 62 connected to frame 50 and by a cam 63 mounted on said frame.

Actuators 64 to 67, such as cylinder and piston devices for example, are mounted on frame 50 and may fold respectively flaps 18.1, 18.5, 18.7, 18.3. Pressers 68 and 69, also mounted on frame 50, are provided for applying the tongue 16 and panel 8 against the face 30 of mandrel 23.

With a blank F1 brought under mandrel 23 so as to be in the position shown in FIG. 5 (see FIGS. 8 and 9), the actuators 57 and 59 are actuated so that, on the one hand, the pressure plate 42 draws closer to mandrel 23 and, on the other hand, the articulated arms 60 and 61, in response to the raising of the mobile assembly 58, fold the panels of blank F1 respectively disposed on each side of panel 3. Blank F1 then takes up, with respect to mandrel 23, successively the relative positions illustrated in FIGS. 6 and 7. Then, with the mobile assembly 58 still rising, the arms 60 and 61 apply panels 5, 6 and 1 respectively against the corresponding faces 27, 28 and 31 of mandrel 23 (see FIGS. 10 and 11).

Presser 68 then applies tongue 16 against the face of the mandrel 23, after which the other presser 69 applies panel 8 against tongue 16 and face 30. Because of the presence of the line of adhesive 54, the panel 8 is then secured to tongue 16 (see FIGS. 12 and 13).

Then the actuators 64 and 65 fold flaps 18.1 and 18.5 against face 41 of mandrel 23 (FIG. 11), after which the actuators 66 and 67 apply respectively flap 18.7 (FIG. 15) then the flap 18.3 (FIG. 16) against the folded flaps 18.1 and 18.5. Because of the lines of adhesive 55 and 56, flaps 18.1, 18.3, 18.5, 18.7 are secured together so as to form the bottom of case C1.

FIGS. 17, 20, 23, 26, 29, 32, 35, 38 and 41 show respectively sheet material blanks F2 to F10 adapted to form cases with rectangular cross section and cut corners, like case C1. In the blanks F2, F3, F5 to F9 of FIGS. 17, 20, 26, 29, 32, 35 and 38 we find again the succession of panels of eight aligned rectangular panels 1 to 8, connected together in twos by preformed parallel fold lines 9 to 15 and bordered by fold lines 20.1, 20.3, 20.5, 20.7, 21.1, 21.3, 21.5 and 21.7, such as described above in connection with FIG. 1. However, in these variants, flaps 18.1, 18.3, 18.5, 18.7 and 19.1, 19.3, 19.5 and 19.7 have different forms, so that the cases obtained C2, C3 and C5 to C9 are different from case C1, although having the same rectangular cross section with cut corners.

Figure 23:
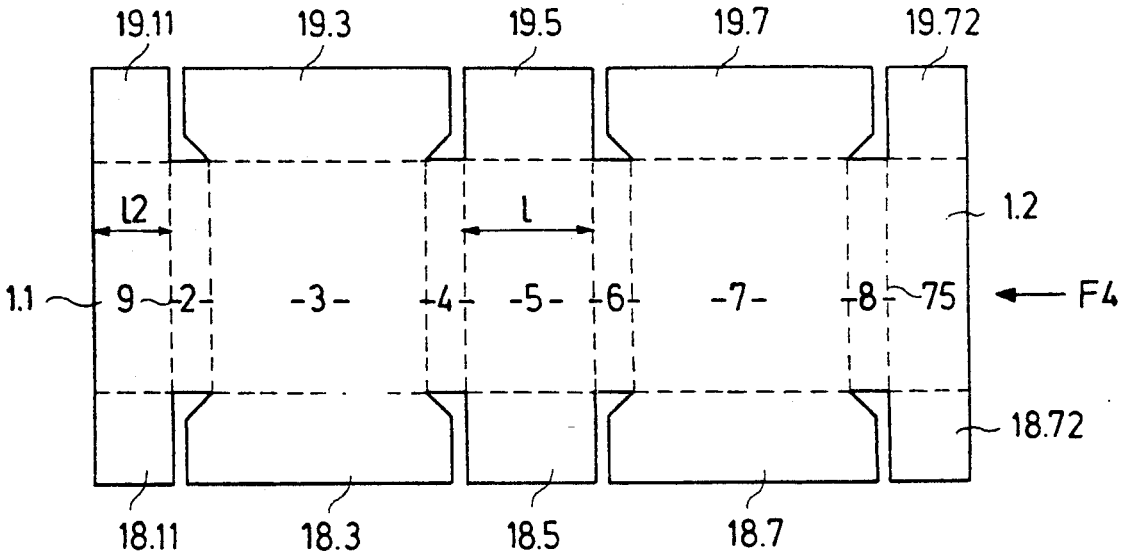
Figure 24:
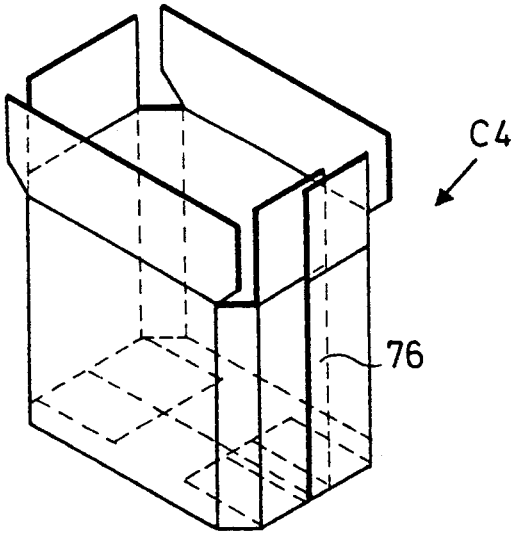
Figure 25:
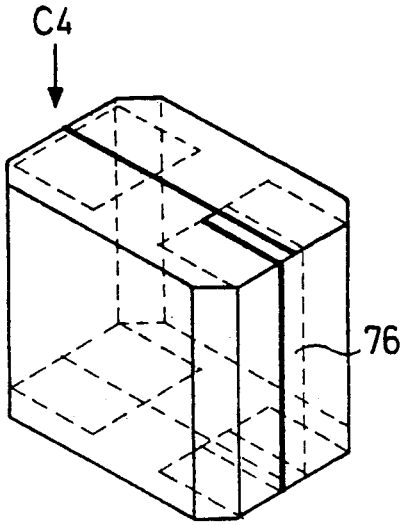
Figure 41:
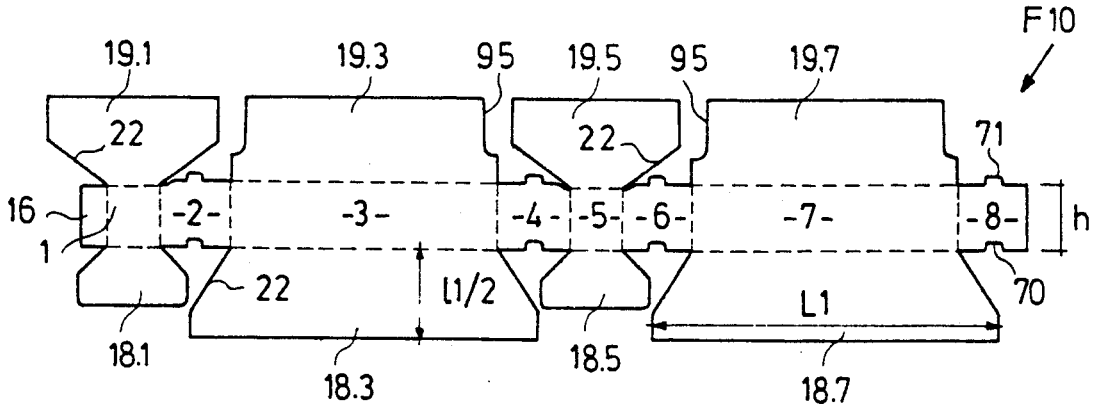
Figure 42:
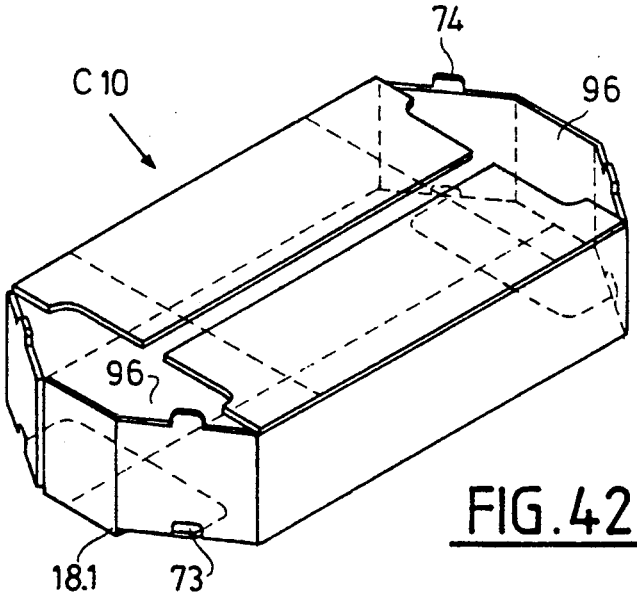
Figure 43:
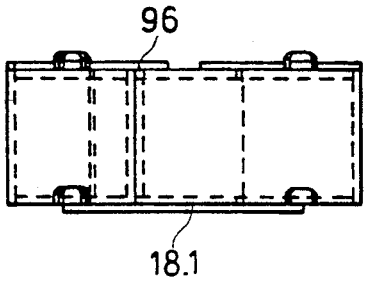
FIG. 43 is an end view of the case of FIG. 42, obtained from the blank of FIG. 41.

In so far as blanks F4 and F10 of FIGS. 23 and 41 are concerned, the succession of aligned rectangular panels 1 to 8 is also different, so that the corresponding cases C4 and C10 are different from case C1 although having a similar cross section.

From the foregoing it will be readily understood that cases C2 to C10 may be obtained using the machine described in connection with FIGS. 5 to 16, possibly by adapting the position and/or the number of glue spreaders 51 to 53, actuators 64 to 67 and pressers 68, 69.

Figure 17:
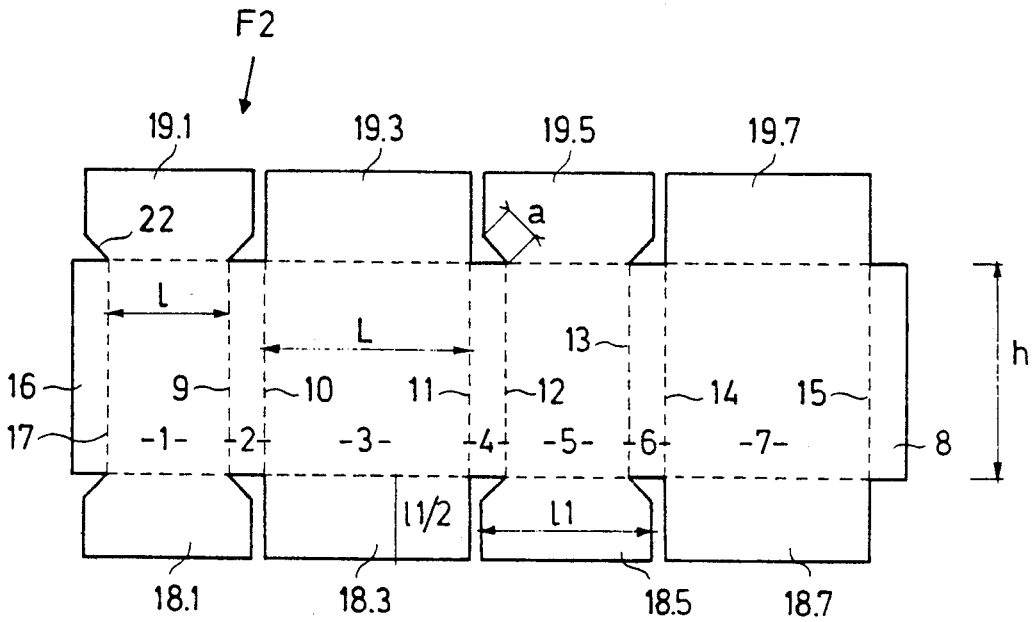
Figure 18:
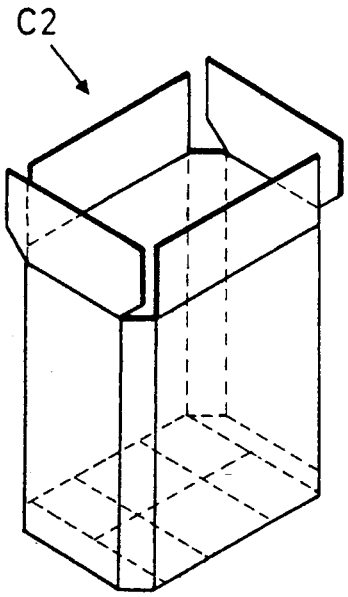
Figure 19:
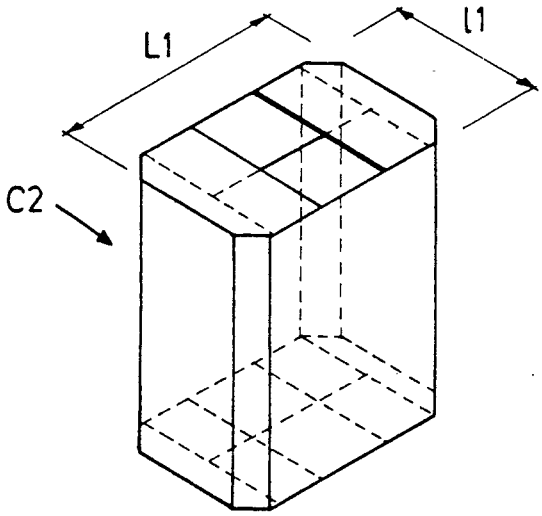

In blank F2 of FIG. 17, the flaps 18.3, 18.7, 19.3, 19.7 are identical and rectangular. They have a length equal to the width L of panels 3 and 7 and a width equal to half 11. In addition, flaps 18.1, 18.5, 19.1, 19.5 are identical with each other and each of them has a length equal to 11. It is flaps 18.1, 18.5, 19.1, 19.5 which therefore comprise, in the vicinity of their fold line with the corresponding panels, the widening provided by the inclined edges 22, the latter having the length a.

Figure 20:
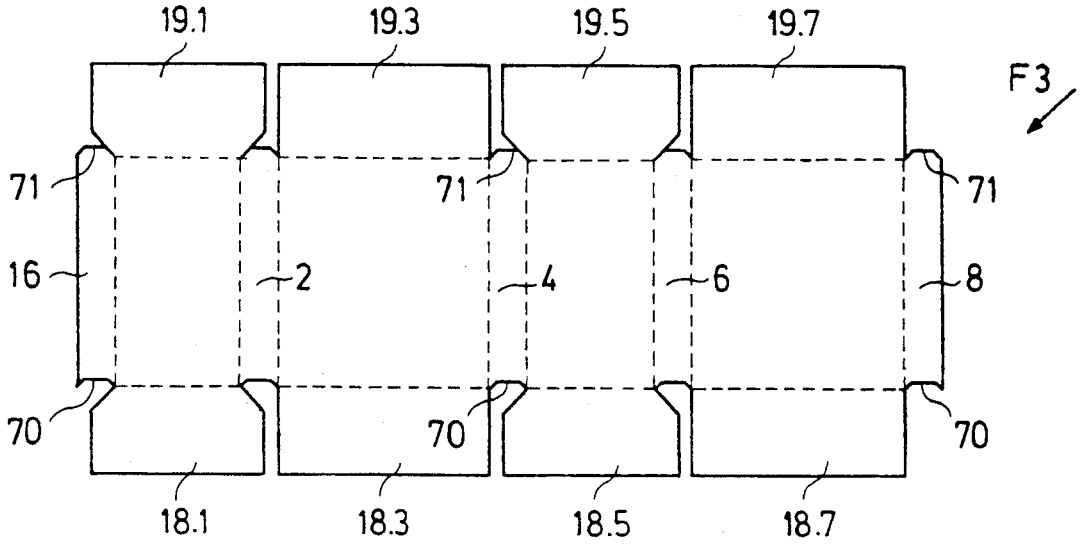
Figure 21:
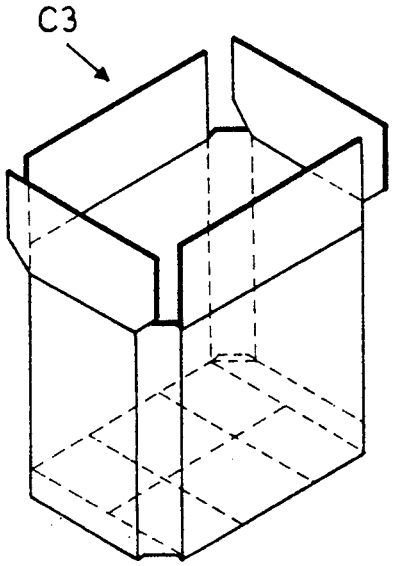
Figure 22:
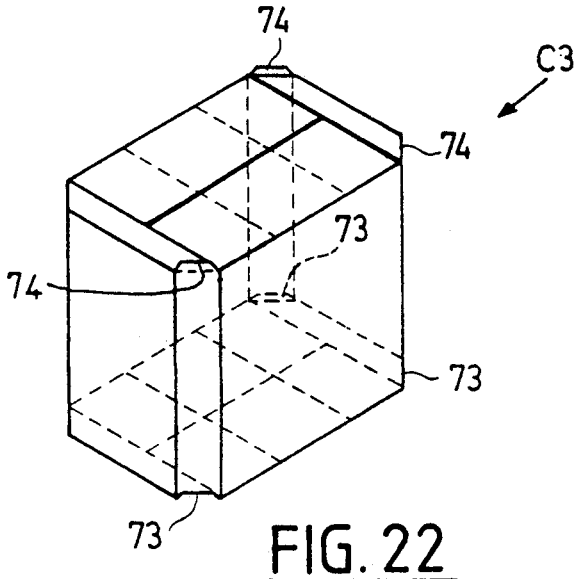

The blank F3 of FIG. 20 is identical to blank F2 of FIG. 2, except in so far as the free edges of panels 2, 4, 6, 8 and tongue 16 are concerned. The free edges of said panels and of said tongue directed towards flaps 18.1, 18.3, 18.5, 18.7 comprise indentations 70 whereas those directed towards flaps 19.1, 19.3, 19.5 and 19.7 comprise projections 71. Thus, case C3 has at its lower part slots 73 and at its upper part stubs 74. When two cases C3 are superimposed, the stubs 74 of the lower case penetrate into the slots 73 of the upper case, so that said cases are held laterally in position with respect to each other.

Panels 2 to 8 and flaps 18.3, 18.5, 18.7, 19.3, 19.5 and 19.7 of blank F4 of FIG. 23 are identical to those of blank F1 of FIG. 1. On the other hand, panel 1, tongue 16 and flaps 18.1 and 19.1 have been omitted and replaced by two rectangular panels 1.1 and 1.2, respectively fast with the outer edges of panels 2 and 9, along fold lines 9 and 75. With each of panels 1.1 and 1.2 are respectively associated rectangular flaps 18.11, 19.11 and 18.72, 19.72. Panels 1.1 and 1.2 and flaps 18.11, 19.11, 18.72 and 19.72 have a width 12 greater than half the width 1 of panel 5. Thus, after blank F4 has been folded about mandrel 23, the panels 1.1 and 1.2 and flaps 18.11, 19.11, 18.72 and 19.72 are superimposed along an overlapping zone 76, along which they may be fastened, for example by gluing.

Figure 26:
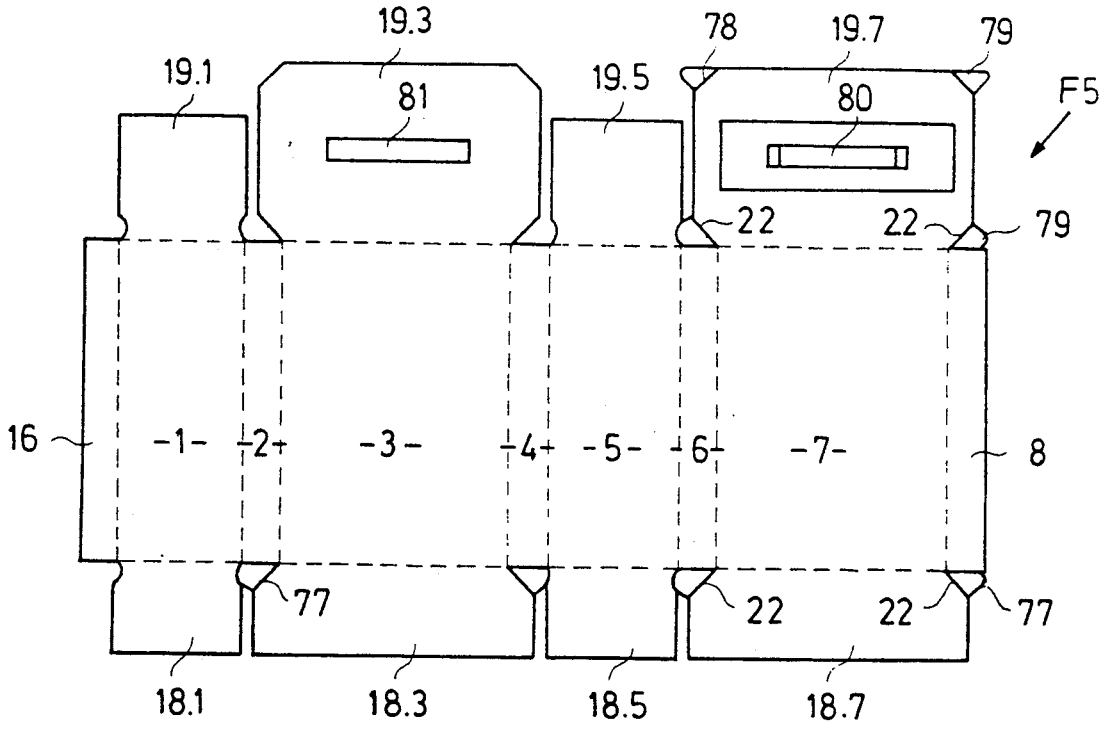
Figure 27:
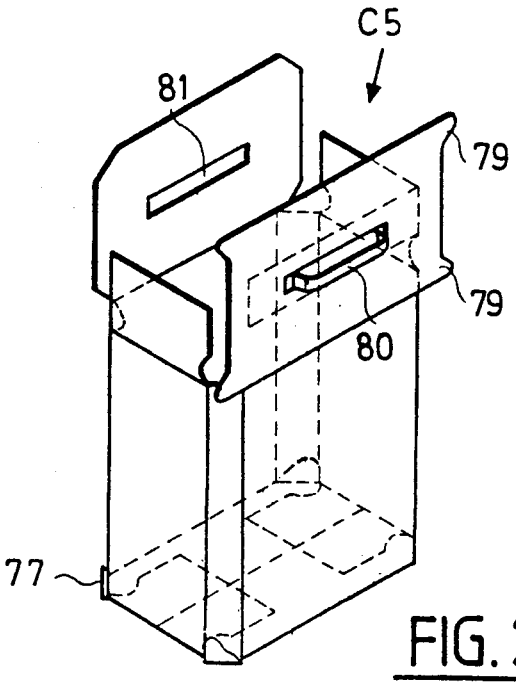
Figure 28:
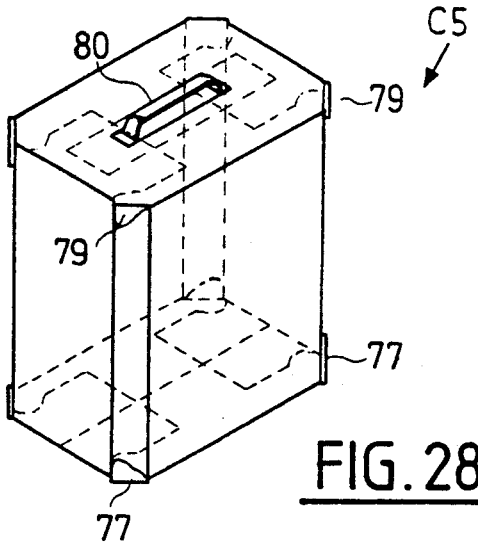
Figure 29:
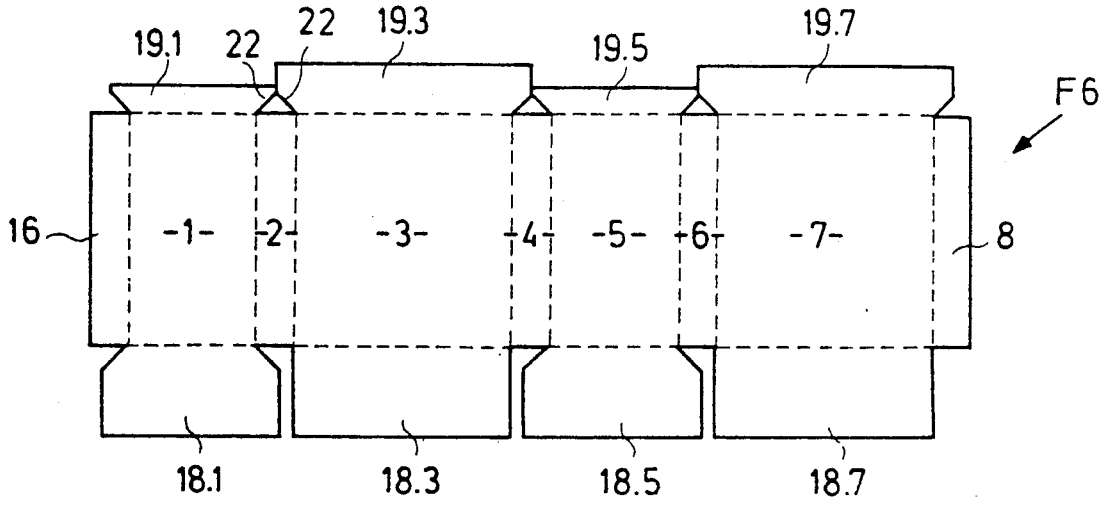
Figure 30:
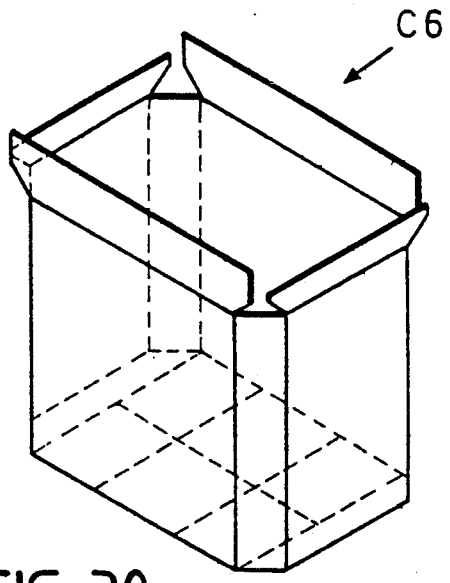
Figure 31:
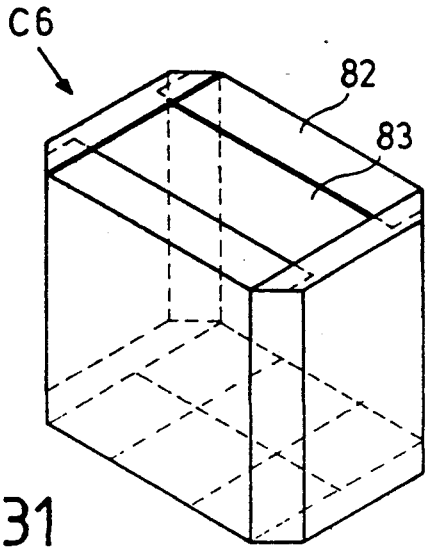

Essentially, in blank F5 of FIG. 26, panels 1 to 8, tongue 16, flaps 18.1, 18.3, 18.5, 18.7, 19.1 and 19.5 are identical to those of blank F1 of FIG. 1. However, along their inclined edges 22, flaps 18.3 and 18.7 comprise lugs 77. Moreover, flaps 19.3 and 19.7 have a form which corresponds to the cross section of case C5. In addition, the inclined edges 22 and 78 of the cut corners of flap 19.7 comprise lugs 79. Thus, when the case C5 is formed from blank F5, lugs 77 and 79 are folded back and fastened to the faces of said case corresponding to panels 2, 4, 6 and 8. The lugs 77 and 79 therefore form reinforcements, connecting the bottom and lid of case C5 to the side wall thereof. In addition, a handle 80 has been provided on flap 19.7, said handle 80 being accessible through a slot 81 provided in flap 19.3, when the latter is folded back over flap 19.7 and fastened thereto.

Figure 9:
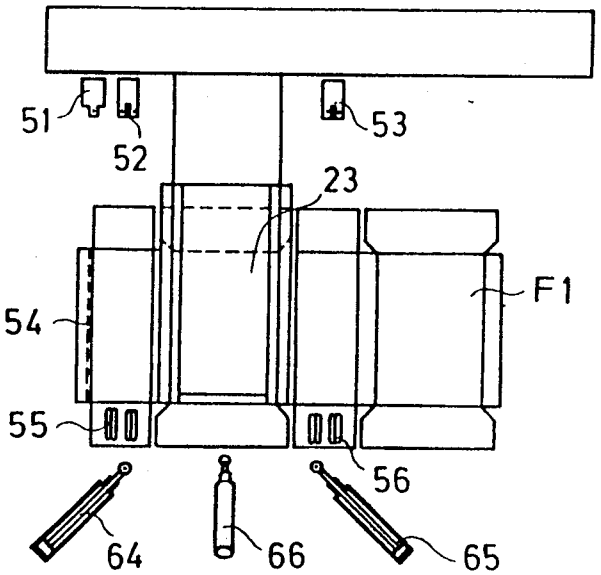
FIGS. 9, 11 and 13 are schematic top views corresponding respectively to FIGS. 8, 10 and 12.

In blank F6 of FIG. 9, the panels 1 to 8, tongue 16 and flaps 18.1, 18.3, 18.5, 18.7 are identical to those of blank F2 of FIG. 17. On the other hand flaps 19.1, 19.3, 19.5 and 19.7 have a small width and all have inclined edges 22. Thus, case C6 comprises a lid formed only of a peripheral border 82, defining a central opening 83.

Figure 32:
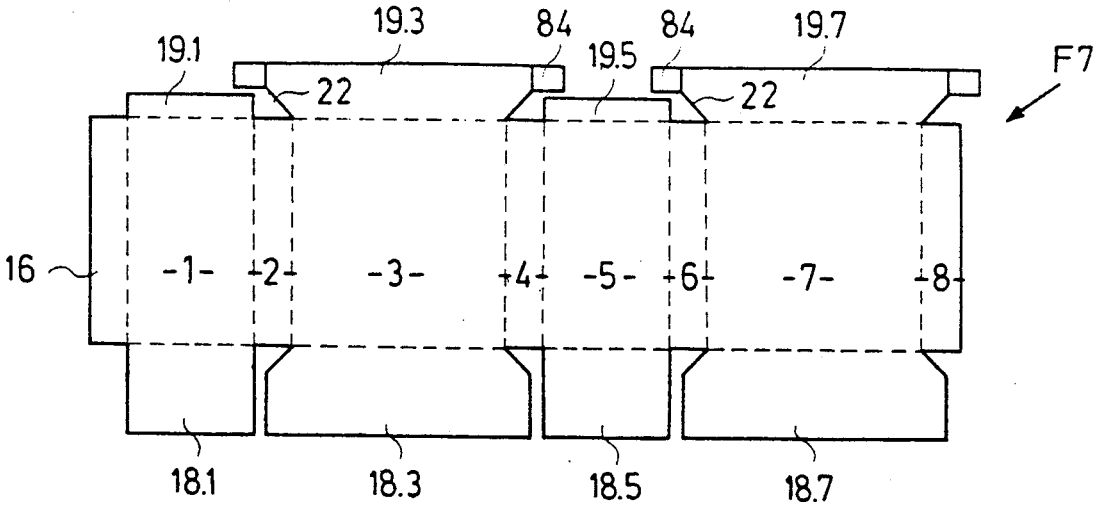
Figure 33:
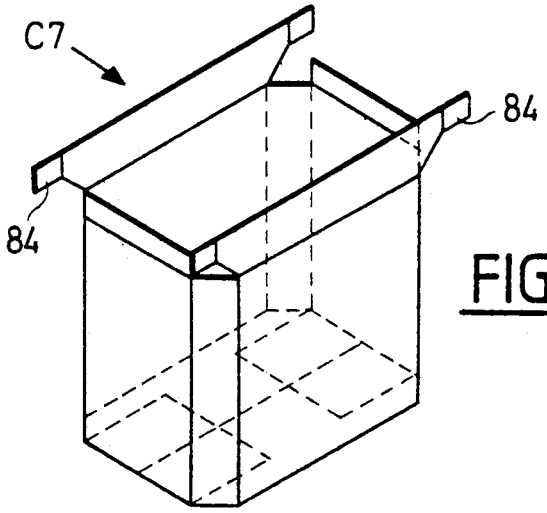
Figure 34:
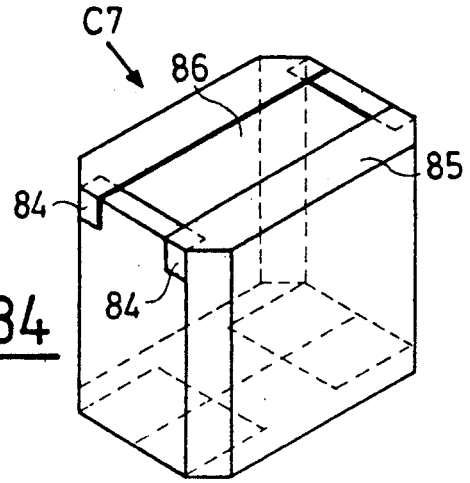

Blank F7 of FIG. 32 comprises panels 1 to 8, a tongue 16 and flaps 18.1, 18.3, 18.5, 18.7 similar to those of blank F1 of FIG. 1. The flaps 19.1 and 19.5 are rectangular, of a length equal to the width 1 of panels 1 and 7 but of small width. Flaps 19.3 and 19.7 comprise inclined widening edges 22, where their width is less than 1½. In addition, in longitudinal extension, said flaps 19.3 and 19.7 comprise lugs 84. Thus, case C7 has a lid formed of a peripheral border 85 defining a central opening 86, lugs 84, after being folded back and glued, fastening said lid to the lateral faces of said case corresponding to panels 1 and 5.

In the blank F8 of FIG. 35, panels 1 to 8 and tongue 16 are identical to those of blanks F1 and F2 of FIGS. 1 and 2. Flaps 18.1, 18.5, 19.1, 19.5 are identical to each other. Similarly, flaps 18.3, 18.7, 19.3, 19.7 are identical to each other. Each flap 18.1, 18.5, 19.1, 19.5 has, in the vicinity of its fold line connecting to the corresponding panel, a widening zone with inclined edges 22, then a narrowing zone with inclined edges 87, of a direction opposite that of edges 22 and finally a zone 88 of constant length. Each flap 18.3, 18.7, 19.3, 19.7 comprises, in the vicinity of its fold line connecting to the corresponding panel, a zone 89 of constant width, then a widening zone with inclined edges 90 and finally a zone 91 of constant length.

The total width of flaps 18.3, 18.7, 19.3, 19.7 is equal to half 11 and their length, at the level of the constant length portion 91, is equal to L1. The case C8 obtained from blank F8 is shown in FIGS. 36 and 37.

Figure 38:
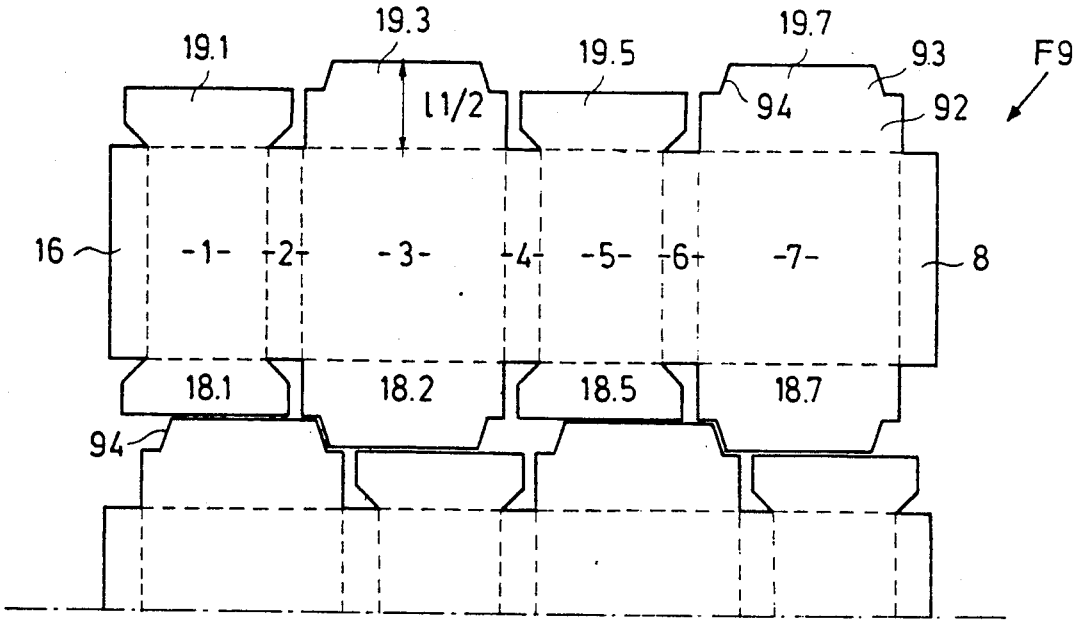
Figure 39:
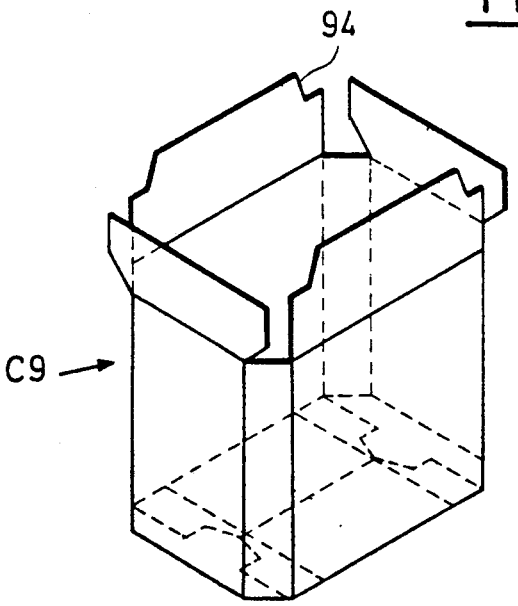
Figure 40:
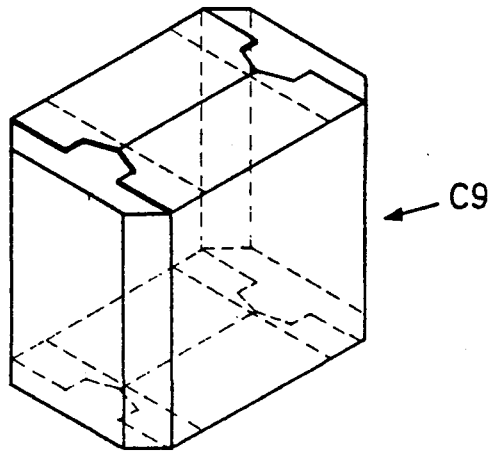

In blank F9 of FIG. 38, the panels 1 to 8, tongue 16 and flaps 18.1, 18.5, 19.1, 19.5 are similar to those of blank F2 of FIG. 17. However, the width of said flaps is less than half 11. Flaps 18.3, 18.7, 19.3, 19.7 are identical to each other. In the vicinity of their fold line connecting to the corresponding panel, they comprise a rectangular portion 92, then a narrowing portion 93 with inclined edges 94. The width of these latter flaps is equal to half 11. As is illustrated in FIG. 38, the manufacture of blanks F9 is economical in sheet material, since two blanks F9 may be interfitted one in the other, with longitudinal offset.

In FIG. 41 a blank F10 has been shown in which the succession of panels 1 to 8 is such that the height h thereof is less than the width L of panels 3 and 7, contrary to what has been shown for blanks F1 to F9 described above. Flaps 18.1 and 18.5 are substantially similar to those of blank F2 of FIG. 17, whereas flaps 18.3 and 18.7 are substantially similar to those of blank F1 of FIG. 1. In addition, flaps 19.1, 19.3, 19.5 and 19.7 are substantially similar to those of blank F2 of FIG. 17. The lateral edges of flaps 19.3 and 19.7 comprise indentations 95.

The bottom of case C10 is formed by folding flaps 18.1 and 18.5 and fixing them on flaps 18.3 and 18.7 which have been previously folded, so that said flaps 18.1 and 18.5 project with respect thereto. The lid of case C10 is formed by folding flaps 19.3 and 19.7 and fixing them on flaps 19.1 and 19.5 which have been previously folded, so that said flaps 19.3 and 19.7, projecting with respect to flaps 19.1 and 19.5 form cavities 96 at the ends of said case. The shape of said cavities 96 corresponds to that of flaps 18.1 and 18.5. Thus, when two cases C10 are superimposed, the projections formed by flaps 18.1 and 18.5 on the bottom of the upper case are housed in the cavities 96 of the lid of the lower case, so that cooperation of projections 18.1 and 18.5 and cavities 96 ensures the vertical stability of said cases. This stability is further reinforced by the fact that panels 2, 4, 6, 8 comprise projections 71 and the indentations 70 of blank F3 of FIG. 20, so that case C10 comprises stubs 74 and recesses 73 similar to those of case C3, facilitating stacking of said cases C10.

Figure 44:
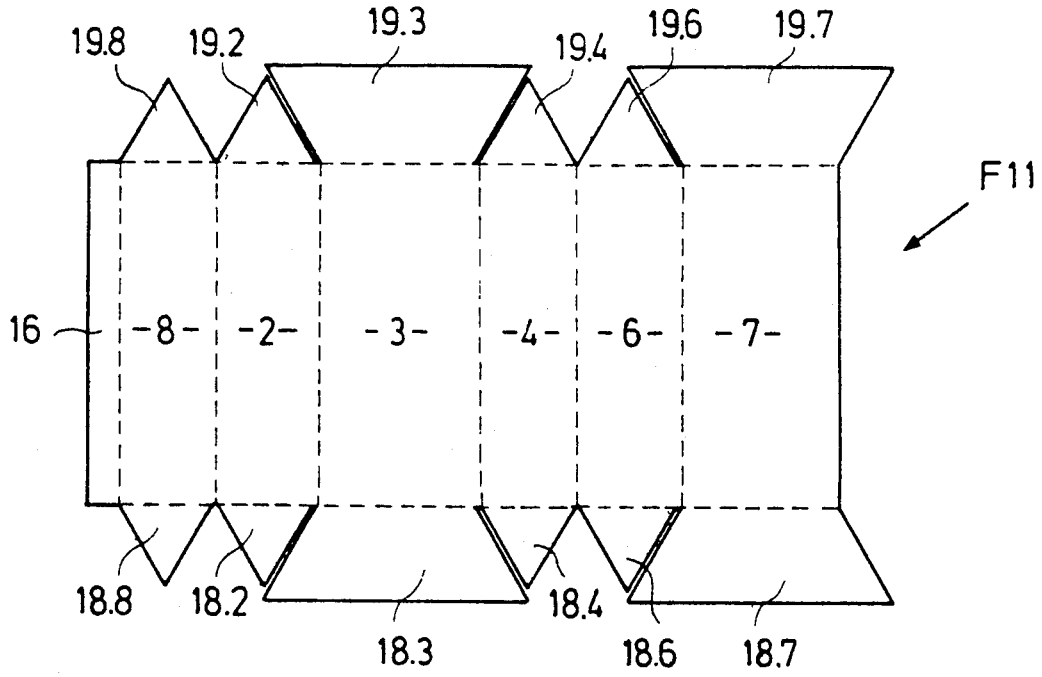
Figure 45:
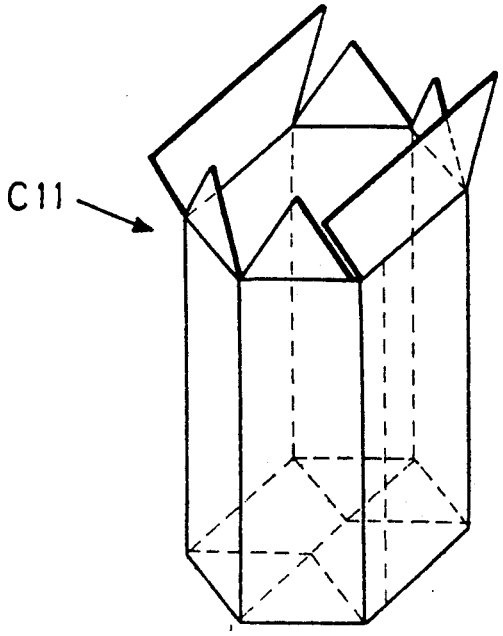
Figure 46:
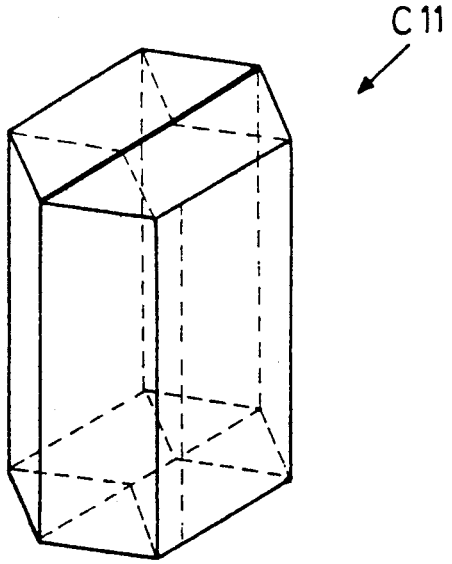
Figure 47:
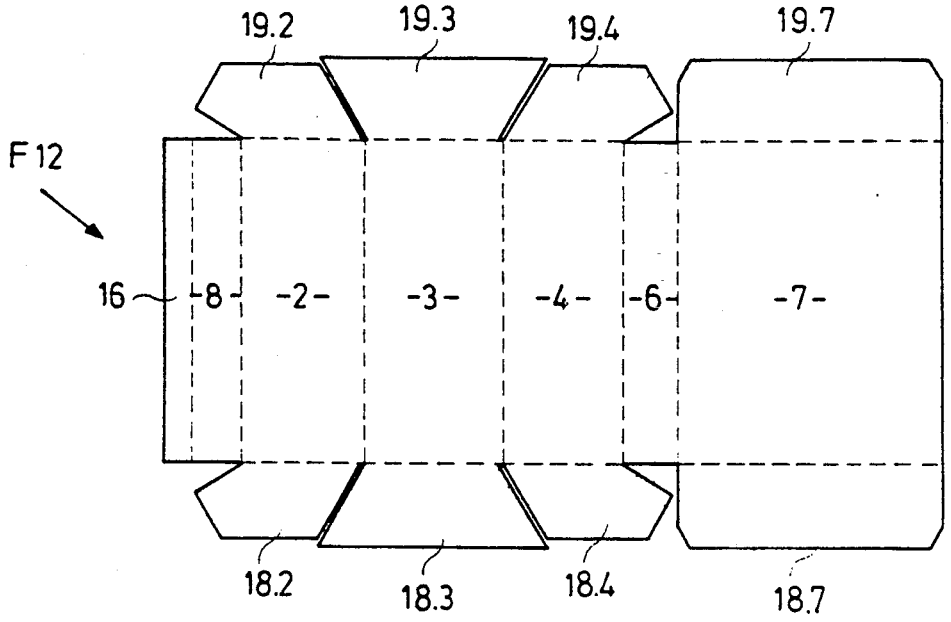

In the blank F11 of FIG. 44, panels 1 and 5 of blanks F1 to F10 described above have been omitted. Furthermore, panel 8 is connected to panel 2 and it carries the tongue 16. The result is that case C11 has a hexagonal and not octagonal cross section. Triangular flaps 18.2, 18.4, 18.6, 18.8, 19.2, 19.4, 19.6 and 19.8 are disposed at the ends of panels 2, 4, 6 and 8. Flaps 18.3, 18.7, 19.3, 19.7 are trapezoidal.

Thus, in the case C11, the corners are widely cut, causing the total suppression, with respect to cases C1 to C10, of the lateral faces corresponding to panels 1 and 5.

Figure 48:
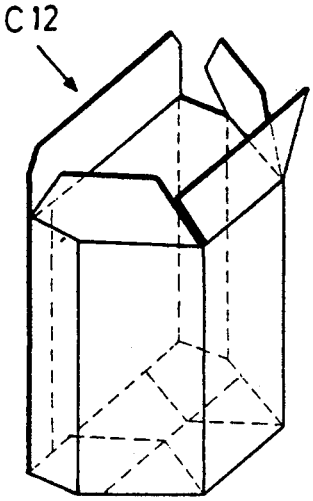
Figure 49:
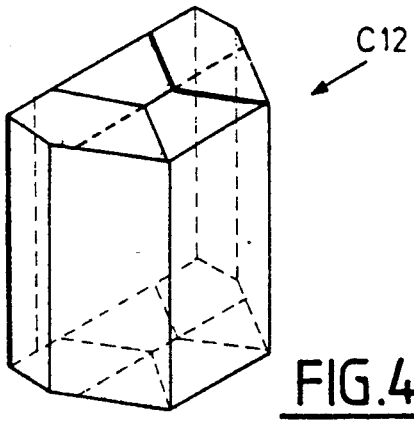

Case C12 of FIGS. 48 to 49 has only two consecutive cut corners. For this, the corresponding blank F12 has the same succession of panels 8, 2, 3, 4, 6, 7 as blank F11 but, after formation of case C12, panels 6 and 8 are orthogonal to panel 7. Panels 6 and 8 have no flap. Panels 2, 3, 4 and 7 comprise flaps 18.2, 18.3, 18.4, 18.7, 19.2, 19.3, 19.4, 19.7 capable of forming the bottom and the lid of case C12.

Figure 50:
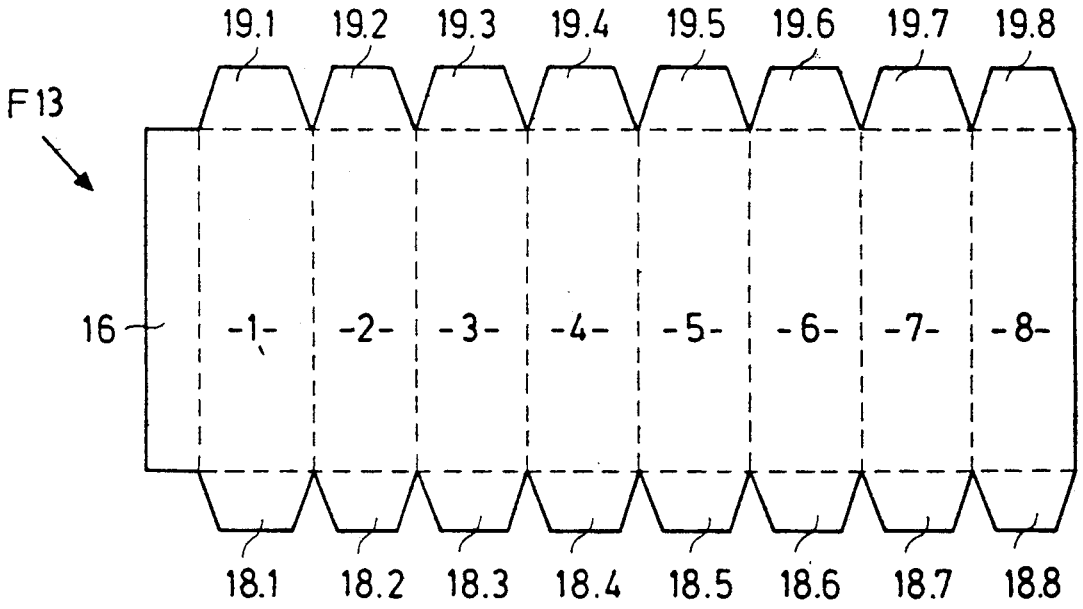
Figure 51:
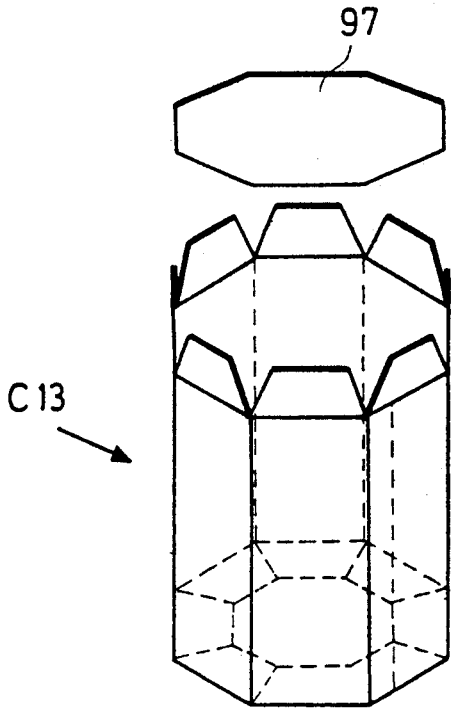
Figure 52:
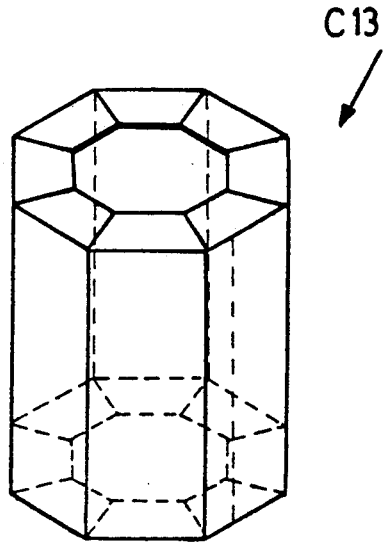

Blank F13 of FIG. 50 comprises a succession of eight identical panels 1 to 8, with which identical trapezoidal flaps 18.1 to 18.8 and 19.1 to 19.8 are respectively associated. The case C13 obtained from blank F13 has then an octagonal cross section corresponding to a square cross section with four cut corners. Octagonal plates 97 are provided for case C13 to form the bottom and lid, respectively in cooperation with flaps 18.1 to 18.8 and 19.1 to 19.8.

Figure 53:
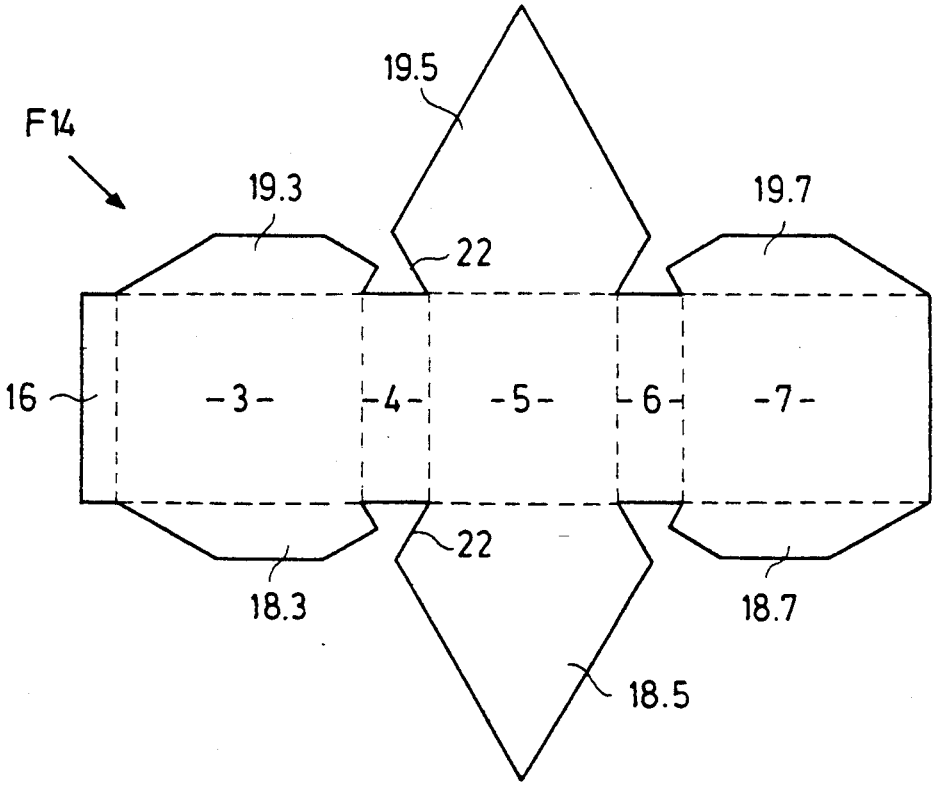
Figure 54:
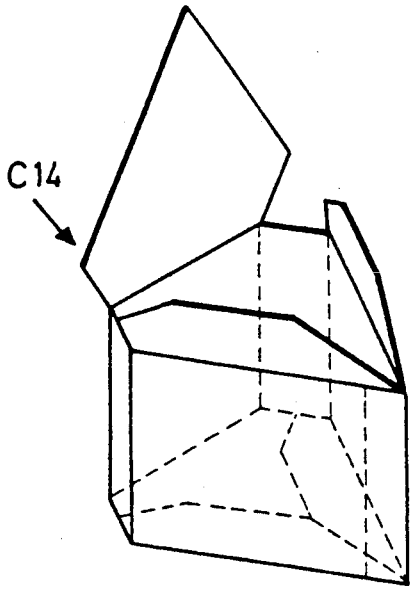
Figure 55:
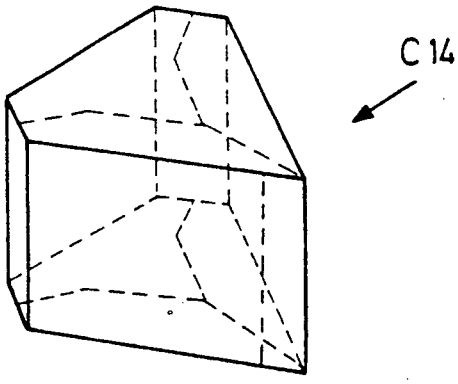
Figure 56:
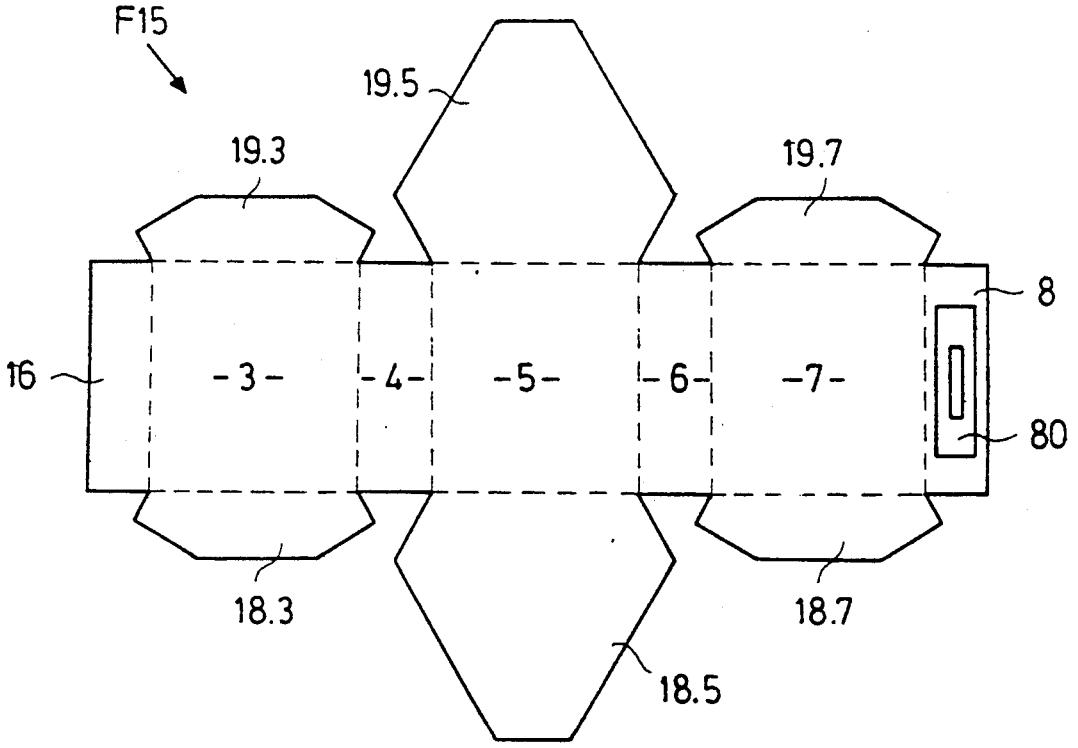
Figure 57:
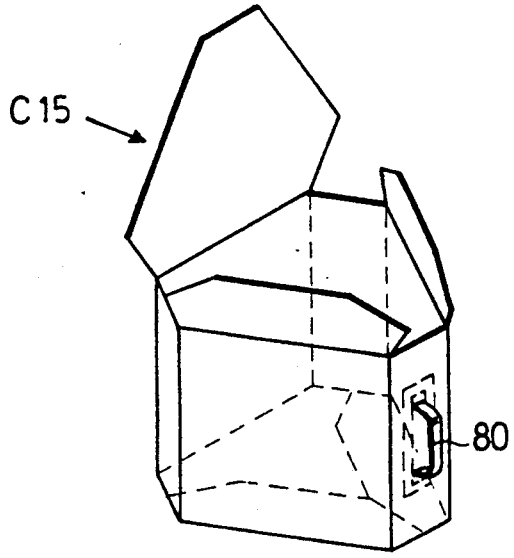
Figure 58:
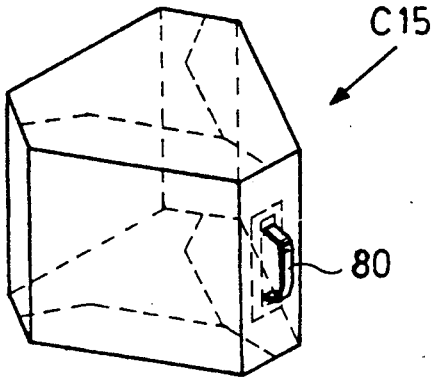

Blank F14 of FIG. 53 has a succession of five panels 3 to 7, tongue 16 being connected to the first panel 3. Case C14 has therefore a triangular cross section with two cut corners. Panel 5 carries flaps 18.5 and 19.5 having a corresponding substantially triangular shape comprising at their base inclined sides 22 so as to be adapted to the lateral faces corresponding to panels 4 and 6. In addition, panels 3 and 7 comprise flaps 18.3, 18.7 and 19.3, 19.7 serving as support for flaps 18.5 and 19.5 and forming the bottom and lid of case C14.

The blank F15 of FIG. 6 is similar to the blank F14 of FIG. 53, but comprises an additional panel 8 and the tip of flaps 18.5 and 19.5 is cut. Case C15 has therefore a triangular cross section with three cut corners. In addition, a handle 80 is provided on panel 8.

It will be readily understood, from what has been described in connection with FIGS. 5 to 16, that cases C11 to C15 may be obtained by wrapping blanks F11 to F15 about mandrels 23 having a shape corresponding to the cross section of said cases, such wrapping taking place in cooperation with a pressure plate 42, whose profile corresponds to that of two, and preferably three, consecutive faces of said mandrel.

What is claimed is:

1. A machine for forming a carton with a polygonal section having at least five faces from a blank having at least five side wall panel elements (1 to 8) delineated by first bending lines (9 to 14) parallel to each other including two end side wall panel elements (1 and 8) and at least three intermediate side wall panel elements (2 to 7), and side flaps (18.1 to 18.7) intended to form the bottom of said carton and respectively connected to said side wall panel elements by second bending lines (20.1 to 20.7) perpendicular to said first bending lines, the free edge of at least one of said end side wall panel elements (1) of said blank having a tongue (16) connected to said one end side wall panel elements by a third bending line (17) parallel to said first bending lines, comprising: a mandrel (23) having an external section corresponding to the inner section of said carton and at least five lateral faces (25 to 32) respectively corresponding to said end and intermediate side wall panel elements (1 to 8);

means for placing one (3) of said intermediate side wall panel elements approximately opposite the corresponding lateral face (25) of said mandrel (23), but at some distance from said corresponding face (25);

means for folding said side wall panel elements respectively adjacent to said one intermediate side wall panel element (3) around the respective first bending lines joining the respective said adjacent sidewall panel elements to said one intermediate sidewall panel element, in such a way that said adjacent side wall panel elements or other side wall elements connected to said adjacent side wall panel elements bear against said mandrel;

a pushing plate (42) having two faces (43 and 44), connected rigidly together, the first (43) of said faces corresponding to said one intermediate side wall panel (3) and the second (44) to a first side wall panel (4) adjacent said one intermediate panel (3), said first and second faces of the pushing plate defining a first dihedral such that, when said first face (43) is applied against said corresponding face (25) of the mandrel, said second face (44) which is applied against the face (26) of said mandrel corresponds to said first adjacent side wall panel (4), the edge (46) of said first dihedral then being in coincidence with the edge (34) of said mandrel defined by said corresponding faces of said mandrel;

means for pushing said intermediate side wall panel element (3) toward said corresponding face (25) of said mandrel by means of said pushing plate (42) and means for maintaining said adjacent side wall panel elements or said other side wall panel elements in contact against said mandrel and making free said intermediate side wall panel element (3) to shift in a direction parallel to said face of said mandrel and perpendicular to said first bending lines, so that said adjacent of other side wall panel elements assist in aligning said intermediate side wall panel element with sad corresponding face of said mandrel, said means for pushing also being for pressing said intermediate side wall panel element (3) against said corresponding lateral face (25) by means of said pushing plate (42);

means for winding said blank around said mandrel so that each of the side wall panel elements is applied against the corresponding face of said mandrel and so that said first bending lines bear against an edge of said mandrel;

means for fixing said tongue to said other end side wall panel element (5);

means for folding said side flaps and for fixing them together for forming the bottom of said carton; and means for ejecting said carton from said mandrel.

2. The machine as claimed in claim 1 wherein said means for wrapping said succession of panels about the mandrel comprise a mobile assembly with swinging arms.

* * * * *